US006181281B1

(12) United States Patent
Desclos et al.

(10) Patent No.: US 6,181,281 B1
(45) Date of Patent: Jan. 30, 2001

(54) SINGLE- AND DUAL-MODE PATCH ANTENNAS

(75) Inventors: Laurent Desclos; Mohammad Madihian, both of Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/448,696

(22) Filed: Nov. 24, 1999

(30) Foreign Application Priority Data

Nov. 25, 1998 (JP) ..... 10-334380
Nov. 26, 1998 (JP) ..... 10-336244

(51) Int. Cl.[7] ..... H01Q 1/38
(52) U.S. Cl. ..... 343/700 MS; 343/767
(58) Field of Search ..... 343/700 MS, 746, 343/767, 768

(56) References Cited

U.S. PATENT DOCUMENTS

| | | | | |
|---|---|---|---|---|
| 4,479,127 | * | 10/1984 | Barbano | 343/742 |
| 5,194,876 | * | 3/1993 | Schnetzer et al. | 343/769 |
| 5,371,507 | * | 12/1994 | Kuroda et al. | 343/700 MS |
| 5,467,095 | * | 11/1995 | Rodal et al. | 343/700 MS |
| 6,023,244 | * | 2/2000 | Snygg et al. | 343/700 MS |

OTHER PUBLICATIONS

D. Sanchez–Hernandez, et al., "Single–Fed Dual Band Circularly Polarised Microstrip Patch Antennas", 26th EuMC–9–12, Sep. 1996, Prague, Czech Republic, pp. 273–277.

P.C. Sharma, et al., "Analysis and Optimized Design of Single Feed Circularly Polarized Microstrip Antennas", *IEEE Transactions on Antennas and Propagation*, vol. AP–31, No. 6, Nov. 1983, pp. 949–955.

* cited by examiner

*Primary Examiner*—Don Wong
*Assistant Examiner*—James Clinger
(74) *Attorney, Agent, or Firm*—Ostrolenk, Faber, Gerb & Soffen, LLP

(57) ABSTRACT

A circularly polarized patch antenna is provided, which facilitates optimization of the axial ratio adjustment and impedance matching, and which has an improved degree of freedom to optimize the axial ratio adjustment and the impedance matching. This antenna is comprised of (a) a dielectric substrate having a first surface located on one side and a second surface located on the other side; (b) an approximately rectangular patch serving as a radiating element formed on the first surface of the substrate; the patch having an aperture from which the first surface of the substrate is exposed, a first side, and a second side adjoining to the first side; the first side having a first slot that inwardly extends approximately perpendicular to the first side; the second side having a second slot that inwardly extends approximately perpendicular to the second side; (c) a ground conductor serving as a ground plane formed on the second surface of the substrate to be opposite to the patch; and (d) a feedpoint located on the patch for feeding or deriving electric power to or from the patch. A second patch is additionally formed over the first surface of the substrate to cover the first patch through a dielectric layer, in which two different operating frequencies are realized.

12 Claims, 17 Drawing Sheets

SINGLE- AND DUAL-MODE PATCH ANTENNAS

BACKGROUND OF THE INVENTION

1. Field of the Invention

The present invention relates to patch antennas applicable mobile or wireless communications systems and more particularly, to a single-mode patch antenna for circularly polarized waves and a dual-mode patch antenna operable as a linearly polarized antenna at a frequency and a circularly polarized antenna at another frequency, which are capable of easy optimization in both impedance matching and axial ratio adjustment.

2. Description of the Prior Art

In the field of mobile communication, various types of patch antennas have been extensively used because of their advantage of compactness, which are equipped with a plate-shaped dielectric substrate and a conductor patch formed on the surface of the substrate.

FIG. 1 shows a prior art circularly polarized patch antenna, which is shown based on the paper written by P. C. Sharma et al., "Analysis and Optimized Design of Single Feed Circularly Polarized Microstrip Antenna", IEEE TAP 1983, Vol., AP-31, No. 6, pp. 949–955.

In FIG. 1, a rectangular conductor patch 151 serving as a radiating element is formed on the surface of a rectangular dielectric substrate 150. The two long sides of the patch 151 have a length of L1 and two short sides thereof have L2. A plate-shaped grounding conductor 153 serving as a ground plane is formed on the opposite surface of the substrate 150 to the patch 151. The reference numeral 152 denotes a feedpoint through which electric power is fed to the patch 151.

The above-described prior-art patch antenna of FIG. 1 has the following problem.

Specifically, with the prior-art patch antenna shown in FIG. 1, electric power is supplied to the patch 151 through the single feedpoint 152 and the antenna structure is very simple. Therefore, there is a problem that a degree of freedom to optimize both the axial ratio setting for circularly polarized waves and the impedance matching at a specific frequency is insufficient.

Also, a monopole or dipole may be additionally provided as an additional radiating element above the patch 151 in order to add another antenna function. In this case, to form a way of feeding electric power to the monopole or dipole thus added, a square or rectangular aperture needs to be formed in the patch 151 to expose the underlying surface of the dielectric substrate 150. However, the aperture causes another problem that the location adjustment of the feed-point 152 becomes more difficult. Also, it causes a further problem that unwanted shift of the axial ratio of elliptically polarized waves is generated and this shift cannot be fully compensated by simply changing the location of the feed-point 152.

FIG. 2 shows another prior-art circularly polarized patch antenna usable at two different frequencies of f1 and f2, which is a dual-frequency antenna. This is shown based on the paper written by D. Sanchez-Hernandez et al., "Single-fed dual band circularly polarized microstrip patch antennas", 26th EuMc 9–12 Sep. 1996, Prague, pp. 273–277.

In FIG. 2, a rectangular patch 257 serving as a radiating element is formed on the surface of a rectangular dielectric substrate 255. The shape and size of the patch 257 are designed to have a resonant frequency at f1. A plate-shaped grounding conductor 253 serving as a ground plane is formed on the opposite surface of the substrate 255 to the patch 257. The reference numeral 256 denotes a feedpoint through which electric power is fed to the patch 257.

Unlike the prior-art antenna shown in FIG. 1, the patch 257 has a L-shaped slit 258A formed near its long side 257*a* and a L-shaped slit 258B formed near its short side 257*b*. The slit 258A extends inwardly by a specific length from a point on the long side 257*a* and then, bends at a right angle and runs parallel to the side 257*a* by a specific length. The part of the slit 258A which is parallel to the long side 257*a* is longer than that which is perpendicular thereto.

Similarly, the slit 258B extends inwardly by a specific length from a point on the long side 257*b* and then, bends at a right angle and runs parallel to the side 257*b* by a specific length. The part of the slit 258B which is parallel to the long side 257*b* is longer than that which is perpendicular thereto.

Here, it is supposed that the parts of the slits 258A and 258B, which are respectively in parallel to the long and short sides 257*a* and 257*b*, have a same width of SLSL and a same length of LSL. If the values of the width WLSL and the length LSL are suitably adjusted, a filter effect is generated due to the existence of the slits 258A and 258B, resulting in a resonant frequency at f2 which is different from f1. Thus, the prior-art patch antenna shown in FIG. 2 have two resonant frequencies at f1 and f2, which means that it serves as a double-frequency antenna.

With the prior art patch antenna shown in FIG. 2, however, if a square or rectangular aperture is formed in the patch 257*a* in order to add a monopole or dipole over the patch 257 as an additional radiating element, the difficulty in location adjustment of the feedpoint 256 is increased due to existence of the slots 258A and 258B. Moreover, since the axial ratio adjustment and the impedance matching become more difficult than the prior art patch antenna shown in FIG. 1, the addition of a monopole or dipole above the patch 257 is extremely difficult to be realized.

To increase the ease in the axial ratio adjustment and impedance matching at different frequencies, several methods have been developed and proposed. However, all the proposed methods require to provide two arrays of patches on a same dielectric substrate. As a result, a large space of patches is necessary and the size of an antenna is increased, which is contrary to the advantage of compactness of patch antennas.

Furthermore, the difficulty in the axial ratio adjustment and the impedance matching is increased by the L-shaped slots 258A and 258B, because the addition of the slots 258A and 258B generates some deviation in the axial ratio and/or the matched impedance.

Actual communications systems require low-cost, small-sized circularly polarized antennas having a well-adjusted axial ratio and a well-matched impedance. However, as far as the inventors know, the prior-art antennas including the above-described antennas shown in FIGS. 1 and 2 provide only one of a well-adjusted axial ratio and a well-matched impedance. This means that the prior-art antennas essentially requires a compromise between the axial ratio adjustment and the impedance matching.

On th other hand, in recent years, there have been the growing need for dual-mode patch antennas capable of operation as a linearly polarized antenna at a frequency and a circularly polarized antenna at another frequency. This need is one the basis of the intention to cope with several different communication systems, such as the ground wave communication systems using linearly polarized waves and the satellite communication systems using circularly polarized waves.

As explained previously, the prior-art patch antenna shown in FIG. 2 is operable at the two different frequencies f1 and f2. However, this antenna is dedicated to circularly polarized waves. Therefore, if it is applied to linearly polarized waves, it will produce a lot of cross polarization components. Thus, it is unable to be operated as a dual-mode patch antenna.

FIG. 3 shows a prior-art dual-mode patch antenna, which is equipped with two patches designed respectively for circularly and linearly polarized waves. This antenna is shown based on the same paper written by P. C. Sharma et al. as that cited with reference to FIG. 1.

As shown in FIG. 3, a first rectangular patch 362 and a second parallelogrammic patch 363 are formed on the surface of a rectangular dielectric substrate 361. These two patches 362 and 363 are apart from each other at a short distance. A plate-shaped grounding conductor 364 serving as a ground plane is formed on the opposite surface of the substrate 361 to the patches 362 and 363. The reference number 365 denotes a feedpoint through which electric power is supplied to the first patch 362. The reference numeral 366 denotes a microstrip line formed on the surface of the substrate 361 to be connected to the second patch 363 at its short side. The line 366 is designed for supplying electric power to the second patch 363.

The first patch 362, which is used for circularly polarized waves, has a shape of a parallelogram with two long sides 362*a* and 362*c* of SL1 and two short sides 362*b* and 362*d* of SL3. By setting precisely the location of the feedpoint 365 on the patch 362, the impedance matching and the axial ratio setting can be suitably established at a desired frequency (i.e., a first frequency).

The second patch 363, which is used for linearly polarized waves, has a shape of a rectangle with two long sides (i.e., resonant sides) 363*a*and 363*c* of RL and two short sides (i.e., non-resonant sides) 363*b* and 363*d* of RW perpendicular to the long sides. The resonance length of the patch 363 is set to be equal to a half wavelength at another desired frequency (i.e., a second frequency).

The first and second patches 362 and 363 and the microstrip line 366 are formed on the dielectric sheet 361 by a well-known printing process or the like.

With the prior-art dual-mode patch antenna shown in FIG. 3, the first parallelogrammic patch 362 dedicated to circularly polarized waves and the second rectangular patch 363 dedicated to linearly polarized waves are provided on the same dielectric substrate 361. Therefore, to prevent the electromagnetic coupling between the patches 362 and 363, these patches 362 and 363 need to be located apart from each other at a specific distance or longer. As a result, this antenna has a problem that it occupies a larger space than that having a single patch and that it raises the fabrication cost.

Moreover, the use of the two patches 362 and 363 may cause another problem that the volume required by the two patches 362 and 363 generates a difficulty in mechanical support of the antenna. It may cause a further problem that two feed systems are necessary to supply electric power to the patches 362 and 363, resulting in a high antenna profile.

SUMMARY OF THE INVENTION

According, an object of the present invention to provide a patch antenna that facilitates optimization of the axial ratio adjustment and impedance matching.

Another object of the present invention to provide a patch antenna having an improved degree of freedom to optimize the axial ratio adjustment and the impedance matching.

Still another object of the present invention to provide a dual-mode patch antenna operable as a linearly polarized antenna at a frequency and as a circularly polarized antenna at another frequency that saves the antenna volume and fabrication cost.

A further object of the present invention to provide a dual-mode patch antenna operable as a linearly polarized antenna at a frequency and as a circularly polarized antenna at another frequency that has a compact body and improved characteristics.

The above objects together with others not specifically mentioned will become clear to those skilled in the art from the following description.

According to a first aspect of the present invention, a circularly polarized patch antenna is provided. This antenna is comprised of (a) a dielectric substrate having a first surface located on one side and a second surface located on the other side;

(b) an approximately rectangular patch serving as a radiating element formed on the first surface of the substrate;

the patch having an aperture from which the first surface of the substrate is exposed, a first side, and a second side adjoining to the first side;

the first side having a first slot that inwardly extends approximately perpendicular to the first side;

the second side having a second slot that inwardly extends approximately perpendicular to the second side;

(c) a ground conductor serving as a ground plane formed on the second surface of the substrate to be opposite to the patch; and (d) a feedpoint located on the patch for feeding or deriving electric power to or from the patch.

With the circularly polarized patch antenna according to the first aspect of the present invention, the first side of the approximately rectangular patch has the first slot that inwardly extends approximately perpendicular to the first side and the second side thereof has the second slot that inwardly extends approximately perpendicular to the second side. Therefore, the effect due to the aperture of the patch can be compensated by the action of the first and second slots.

As a result, both the axial ratio adjustment and the impedance matching can be optimized easily by suitably setting the size and number of the fist and second slots if popular computer simulation or the like is utilized. In other words, this patch antenna has an improved degree of freedom to optimize the axial ratio adjustment and the impedance matching.

In a preferred embodiment of the antenna according to the first apsect, the first side of the patch further has a least one additional slot and the second side of the patch further has at least one additional slot. In this embodiment, there is an additional advantage that the effect due to the aperture of the patch can be compensated more easily.

The first slot and the additional slot of the first side may be equal to or different from each other in width and/or length. The second slot and the additional slot of the second side may be equal to or different from each other in width and/or length. The gap between the first slot and the additional slot of the first side may be equal to or different from that between the second slot and the additional slot of the second side.

According to a second aspect of the present invention, another circularly polarized patch antenna is provided, which is comprised of (a) a dielectric substrate having a first surface located on one side and a second surface located on the other side;

(b) an approximately rectangular first patch serving as a first radiating element formed on the first surface of the substrate;

the first patch having an aperture from which the first surface of the substrate is exposed, a first side, and a second side adjoining to the first side;

the first side having a first slot that inwardly extends approximately perpendicular to the first side;

the second side having a second slot that inwardly extends approximately perpendicular to the second side;

(c) a dielectric layer formed on the first surface or the substrate to cover entirely the first patch;

(d) an approximately rectangular second patch serving as a second radiating element formed on a surface of the dielectric layer;

the second patch having a second aperture from which the surface of the dielectric layer is exposed, a third side, and a fourth side adjoining to the third side;

the third side having a third slot that inwardly extends approximately perpendicular to the third side;

the fourth side having a fourth slot that inwardly extends approximately perpendicular to the fourth side;

(e) a ground conductor serving as a ground plane formed on the second surface of the substrate to be opposite to the first patch;

(f) a first feedpoint located on the first path for reading or deriving electric power to or from the first patch; and (g) a second feedpoint located on the second patch for feeding or deriving electric power to or from the second patch.

With the circularly polarized patch antenna according to the second aspect of the present invention, the dielectric layer and the second patch are added to the circularly polarized antenna according to the first aspect. Therefore, because of the same reason as that of the antenna according to the first aspect, both the axial ratio adjustment and the impedance matching can be optimized easily. In other words, the patch antenna according to the second aspect has an improved degree of freedom to optimize both the axial ratio adjustment and the impedance matching. Unlike the antenna according to the first aspect, the antenna according to the second aspect is operable at two different frequencies.

In a preferred embodiment of the antenna according to the second aspect, the first side of the first patch further has at least one additional slot, the second side of the first patch further has at least one additional slot, the third side of the second patch further has at least one addition slot, and the fourth side of the second patch further has at least one additional slot. In this embodiment, there is an additional advantage that the effect due to the aperture of the patch can be compensated more easily.

The first slot and the additional slot of the first side of the first patch may be equal to or different from each other in width and/or length. The second slot and the additional slot of the second side of the first patch may be equal to or different from each other in width and/or length. The gap between the first slot and the additional slot of the first side may be equal to or different from that between the second slot and the additional slot of the second side. This is applicable to the second patch.

According to a third aspect of the present invention, a dual-mode patch antenna is provided, which is comprised or (a) a dielectric substrate having a first surface located on one side and a second surface located on the other side;

(b) a first patch serving as a first radiating element formed on the first surface of the substrate;

the first patch having an opening from which the first surface of the substrate is exposed;

(c) a second patch serving as a second radiating element formed on the first surface of the substrate;

the second patch being located in the opening of the first patch and apart from the first patch at a specific gap;

(d) a ground conductor serving as a ground plane formed on the second surface of the substrate to be opposite to the first and second patches; and (e) a first feed line located on the first surface of the substrate for feeding or deriving electric power to or from the first patch.

With the dual-mode patch antenna according to the third aspect of the present invention, since the second patch is located in the opening of the first patch to be apart therefrom, the second patch is electro-magnetically coupled with the first patch. As a result, the first patch serves to form a linearly polarized antenna at a first frequency and the second patch serves to form a circularly polarized antenna at a second frequency higher than the first frequency.

By suitably setting the value of the gap between the first and second patches and/or the shape of the aperture and the second patch, the coupling effect between the first and second patched can be adjusted as necessary. Thus, both the axial ratio adjustment and the impedance matching can be optimized easily, which is easily realized by utilizing popular computer simulation or the like. In other words, this patch antenna has an improved degree of freedom to optimize that axial ratio adjustment and the impedance matching, which leads to improved antenna characteristics.

Moreover, since the second patch is contained in the aperture of the first patch, this antenna saves the antenna volume and the fabrication cost, resulting in a compact body of a dual-mode patch antenna.

In a preferred embodiment of the dual-mode patch antenna according to the third aspect, the first patch is approximately rectangular and the second patch is approximately quardrilateral. The aperture of the first patch has a hope corresponding to a contour of the second patch. The first feed line is connected to the first patch. In this embodiment, the advantages of the invention are exhibited conspicuously.

In another preferred embodiment of the dual-mode patch antenna according to the third aspect, a second feed line is additionally formed on the first surface of the substrate for feeding or deriving electric power to or from the second patch. The aperture of the first patch is formed to communicate with its outside through a hole of the first patch. The second feed line is connected to the second patch through the hole. In this embodiment, there is an additional advantage that feeding or deriving electric power to or from the first and second patches is independently adjusted.

In still another preferred embodiment of the dual-mode patch antenna according to the third aspect, feeding or deriving electric power to or from the second patch is performed by using the first feed line by way of the first patch. In this embodiment, there is an additional advantage that the structure of a feed system connected to the first feed line is simplified.

According to a fourth aspect of the present invention, another dual-mode patch antenna is provided, which is comprised of (a) a dielectric substrate having a first surface located on one side and a second surface located on the other side;

(b) a first patch serving as a first radiating element formed on the first surface of the substrate;

the first patch having first to (n−1)-th apertures from which the first surface of the substrate is exposed, where n is an integer greater than two;

(c) second to n-th patches serving as a second radiating element formed on the first surface of the substrate;

the second to n-th patches being respectively located in the first to (n−1)-th apertures of the first patch and apart from the first patch at specific gaps, respectively;

(d) a ground conductor serving as a ground plane formed on the second surface of the substrate to be opposite to the first to n-th patches; and (e) a first feed line located on the first surface of the substrate for feeding or deriving electric power to or from the first patch.

With the dual-mode patch antenna according to the fourth aspect of the present invention, since the second to n-th patches are respectively located in the first to (n−1)-th apertures of the first patch to be apart therefrom, the second to n-th patches are electro-magnetically coupled with the first patch. As a result, the first patch serves to form a linearly polarized antenna at a first frequency and the combination of the second to n-th patches serves to form a circularly polarized antenna at a second frequency higher than the first frequency.

By suitably setting the value of the gaps between the first patch and the second to n-th patches and/or the shape of the first to (n−1)-th apertures and the second to n-th patches, the coupling effect between the first patch and the second to n-th patches can be adjusted as necessary. Thus, both the axial ratio adjustment and the impedance matching can be optimized easily, which is easily realized by utilizing popular computer simulation or the like. In other words, this patch antenna has an improved degree of freedom to optimize the axial ratio adjustment and the impedance matching, which leads to improved antenna characteristics.

Compared with the antenna according to the third aspect, the degree of freedom is higher, because the second to n-th patches are provided.

Moreover, since the second to n-th patches are contained in the first to (n−1)-th apertures of the first patch, this antenna saves the antenna volume and the fabrication cost, resulting in a compact body of a dual-mode patch antenna.

In a preferred embodiment of the dual-mode patch antenna according to the fourth aspect, the second to n-th patches are arranged along a non-resonant side of the first patch. Electric power is supplied to or derived from the second to n-th patches using electro-magnetic coupling between the first patch and the second to n-th patches. In this embodiment, there is an additional advantage that the structure of a feed system connected to the first feed line is simplified.

It is preferred that the second to n-th patches are entirely located in the first to (n−1)th apertures of the first patch, respectively. In this case, there is an additional advantage that the antenna volume becomes smaller.

In another preferred embodiment of the dual-mode patch antenna according to the fourth aspect, the first patch is approximately rectangular and the second to n-th patches are approximately quadrilateral. In this embodiment, the advantages of the invention are exhibited conspicuously.

BRIEF DESCRIPTION OF THE DRAWINGS

In order that the present invention may be readily carried into effect, it will now be described with reference to the accompanying drawings.

FIG. 10 is a graph showing the radiation pattern of the antenna according to the third embodiment of FIG. 11 by the direction dependence of the gain at the frequency of 2.12 GHz, which was obtained by computer simulation.

DETAILED DESCRIPTION OF THE PREFERRED EMBODIMENTS

Figure 1:
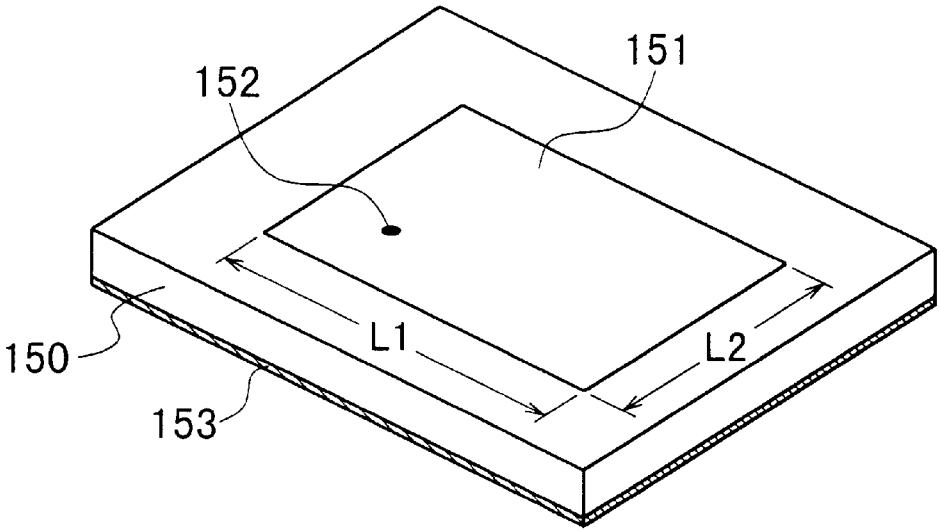
FIG. 1 PRIOR ART
FIG. 1 is a schematic perspective view showing a prior-art circularly polarized antenna operable at a frequency band.
Figure 2:
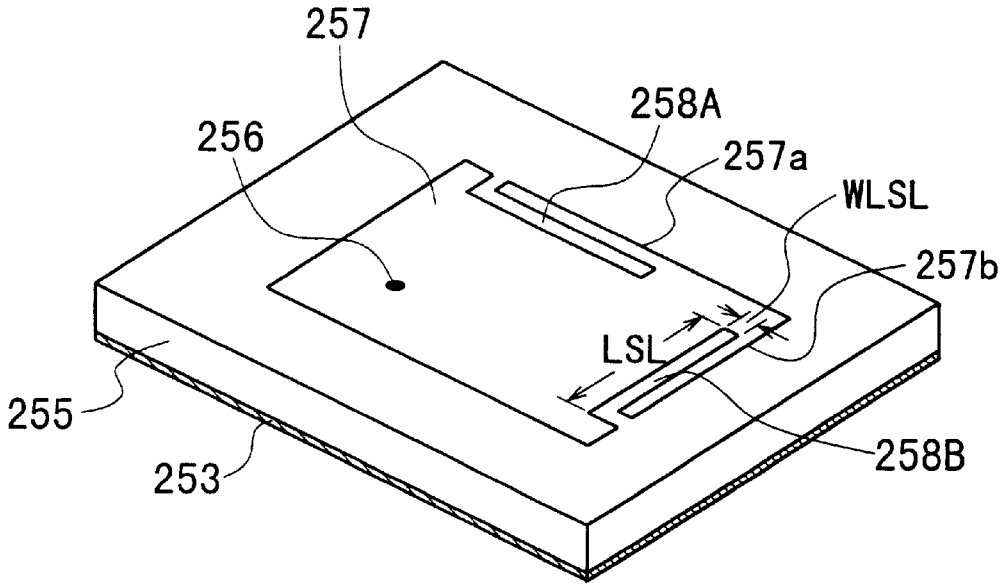
FIG. 2 PRIOR ART
FIG. 2 is a schematic perspective view showing another prior-art circularly polarized antenna operable at two different frequency bands.

Preferred embodiment of the present invention will be described in detail below while referring to the drawings attached.

First Embodiment

Figure 4:
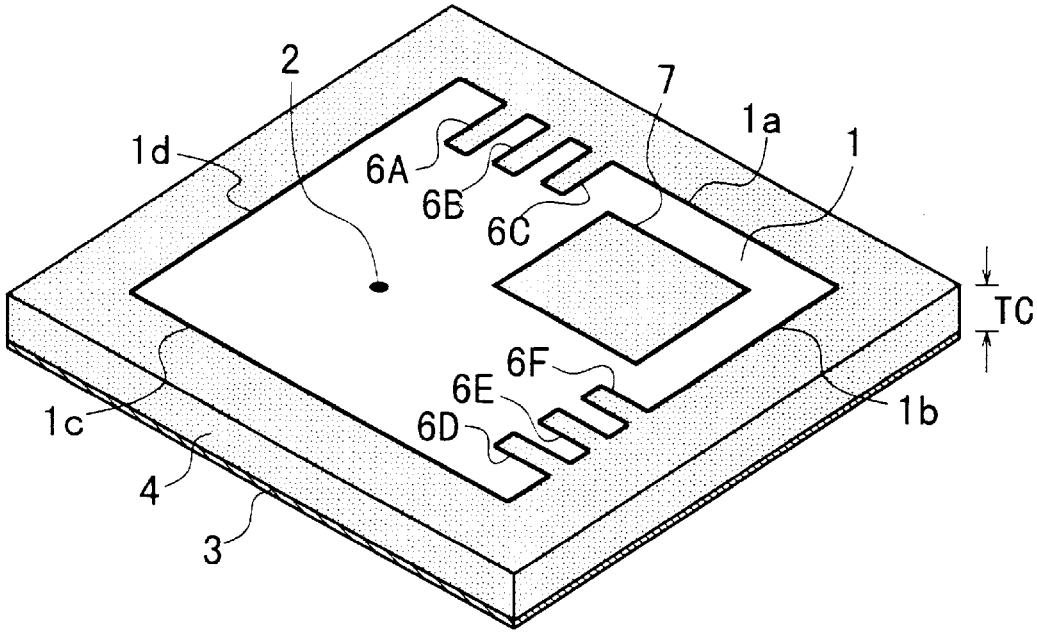
FIG. 4 is a schematic perspective view showing the configuration of a circularly polarized antenna operable at a frequency band according to a first embodiment of the present invention.
Figure 5:
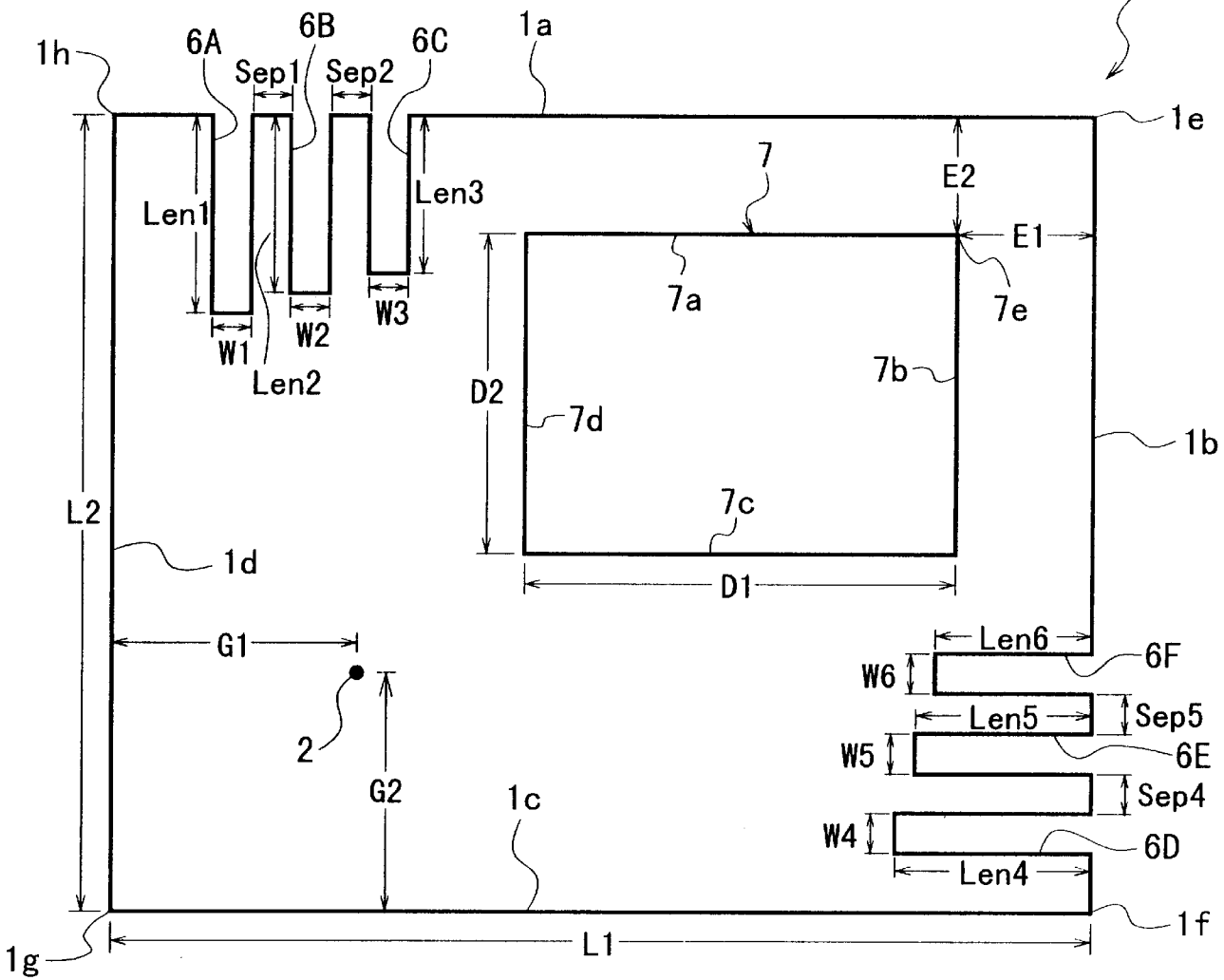
FIG. 5 is an enlarged plan view showing the configuration of the patch of the antenna according to the first embodiment of FIG. 4.

A circularly polarized patch antenna according to a first embodiment of the present invention is shown in FIGS. 4 and 5, which is connected to an unillustrated matching network for impedance matching between the antenna and a feed system. Since this connection is very popular, the explanation about that is omitted here for simplification of description.

As shown in FIG. 4, the patch antenna according to the first embodiment is comprised of a dielectric substrate 4 having a thickness of TC and a dielectric constant of P1, an approximately rectangular conductor patch 1 serving as a radiating element formed on the upper surface of the substrate 4, and a rectangular plate-shaped ground conductor 3 serving as a ground plane formed on the lower surface of the substrate 4 to be opposite to the patch 1.

As clearly shown in FIG. 5, the patch 1 has two lone sides 1*a* and 1*c* with the same length of L1 and two short sides 1*b* and 1*d* with the same length of L2, where L1>L2. The patch 1 has a rectangular aperture 7 that exposes the upper surface of the dielectric substrate 4 from the patch 1. The aperture 7 is formed to provide an additional antenna element such as a monopole or dipole onto the upper surface of the substrate 4 while electrically separating the additional antenna element from the patch 1. The aperture 1 has two long sides 7*a* and 7*c* with the same length of D1 and two short sides 7*b* and 7*d* with the same length of D2, where D1>D2.

The corner 7*e* of the aperture 7 is the nearest to the corner 1*e* of the patch 1. The corner 7*e* is apart from the adjoining short side 1*b* of the patch 1 by a distance E1 and from the adjoining long side 1*a* of the patch 1 by a distance E2.

A feedpoint 2 for feeding electric power to the patch 1 is located at a point nearest to the corner 1*g* of the patch 1 opposite to the corner is thereof. The feedpoint 2 is apart from the adjoining short side 1*d* of the patch 1 by a distance G1 and from the adjoining long side 1*c* of the patch 1 by a distance G2. Electric power is supplied to the patch 1 from its backside at the feedpoint 2 by way of a feed line (not shown) which is electrically connected to the feedpoint 2 through the substrate 4.

The patch 1 includes three rectangular slots 6A, 6B, and 6C at its long side 1*a* and three rectangular slots 6D, 6E, and 6F at its short side 1*b*. The slots 6A, 6B, and 6C, which are located near the corner 1*h* of the patch 1, extend inwardly from the long side 1*a* to be perpendicular thereto. In other words, the slots 6A, 6B, and 6C extend in parallel to the short sides 1*b* and 1*d*. The widths of the slots 6A, 6B, and 6C are defined as W1, W2, and W3, and the lengths thereof are as Len1, Len2, and Len3, respectively. The slots 6A and 6B are apart from each other at a distance of Gepl, and a the slots 6B and 6C are at a distance of Sep2.

The slots 6D, 6E, and 6F, which are located near the corner 1*f* of the patch 1 opposite to its corner 1*h*, extend inwardly from the short side 1*h* to be perpendicular thereto. In other words, the slots 6D, 6E, and 6F extend in parallel to the long sides 1*a*and 1*c* and perpendicular to the short sides 1*b* and 1*d*. The widths of the slots 6D, 6E, and 6F are defined as W4, W5, and W6, and the lengths thereof are as Len4, Len5, and Len6, respectively. The slots 6D and 6E are apart from each other at a distance of Sep4, and the slots 6E and 6F are at a distance of Sep5.

By suitably setting the values of the widths W1, W2, W3, W4, W5, and W6, the lengths Len1, Len2, Len3, Len4, Len5, and Len6, and the distance Sep1, Sep2, Sep3, and Sep4 of the slots 6A, 6B, 6C, 6D, 6E, and 6F, both the axial ratio setting and the impedance matching can be optimized at a desired frequency f1.

It is needless to say that the values of the widths W1, W2, W3, W4, W5, and W6 may be equal to or different from each other according to the necessity. This is applied to the values of the lengths Len1, Len2, Len3, Len4, Len5, and Len6, and those of the distances Sep1, Sep2, Sep3, and Sep4.

A numerical example of the patch 1 is shown below.

The dielectric substrate 4 is formed by a polyphenylene oxide (PPO) sheet or plate with the thickness TC of 3.2 mm and the dielectric constant P1 of 10. The patch 1 has the long side length L1 of 19.32 mm and the short side length L2 of 18.29 mm, which is formed by a well-known printing process. The rectangular aperture 7 has the long side length D1 of 7 mm and the short side length D2 of 6.726 mm. The distances E1 and E2 of the aperture 7 are both set as 3.5 mm. The distances G1 and G2 of the feedpoint 2 are 8.26 mm and 8.1 mm, respectively.

The widths W1, W2, and W3 of the three slots 6A, 6B, and 6C on the long side 1*a* are 0.5 mm. The lengths Len1, Len2, and Len3 of the three slots 6A, 6B, and 6C are 2 mm. The distances Scp1 and Scp2 are 0.5 mm. The widths W4, W5, and W6 of the three slots 6C, 6D, and 6E on the short side 1*b* are 0.5 mm, which are equal to those of the slots 6A, 6B, and 6C. The lengths Len4, Len5, and Len6 of the three slots 6D, 6E, and 6F are 2 mm, which are equal to those of the slots 6A, 6B, and 6C. The distances Sep4 and Sep5 are 0.5 mm, which are equal to those of the slots 6A, 6B, and 6C. Thus, the six slots 6A, 6B, 6C, 6D, 6E, and 6F are equal in size, shape, and distance.

Using the patch antenna according to the first embodiment specified as above, the inventors actually performed computer simulation to obtain the frequency dependence of the axial ratio, the gain, and the component S11 of the S parameter and the radiation pattern. The results of the simulation is shown in FIGS. 6 and 7.

Figure 6:
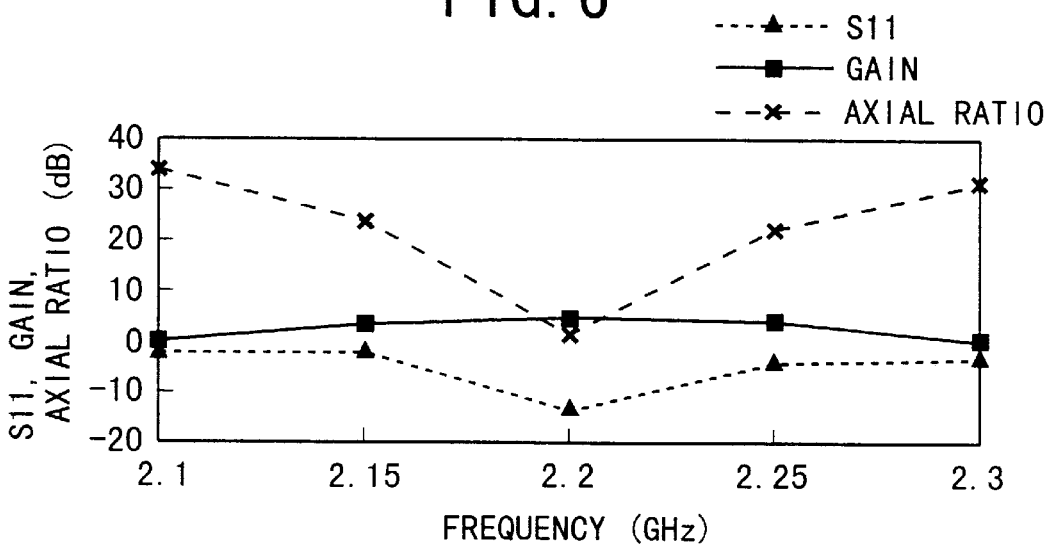
FIG. 6 is a graph showing the frequency dependence of the axial ratio, the gain, and the component S11 of the S parameter of the antenna according to the first embodiment of FIG. 4, which was obtained by computer simulation.

As seen from FIG. 6, the axial ratio of the elliptically polarized waves is minimized at the frequency of 2.2 GHz, which is lower than 1 dB. Also, the component S11 of the S parameter, which is defined as the rate of the reflected wave with respect to the incident wave, is minimized at the frequency of 2.2 GHz. This means that the impedance matching between the patch antenna and its feed line is optimized. In response to the optimized impedance, the antenna gain is maximized at the same frequency of 2.2 GHz. The impedance matching thus obtained was as high as approximately 14 dB.

Figure 7:
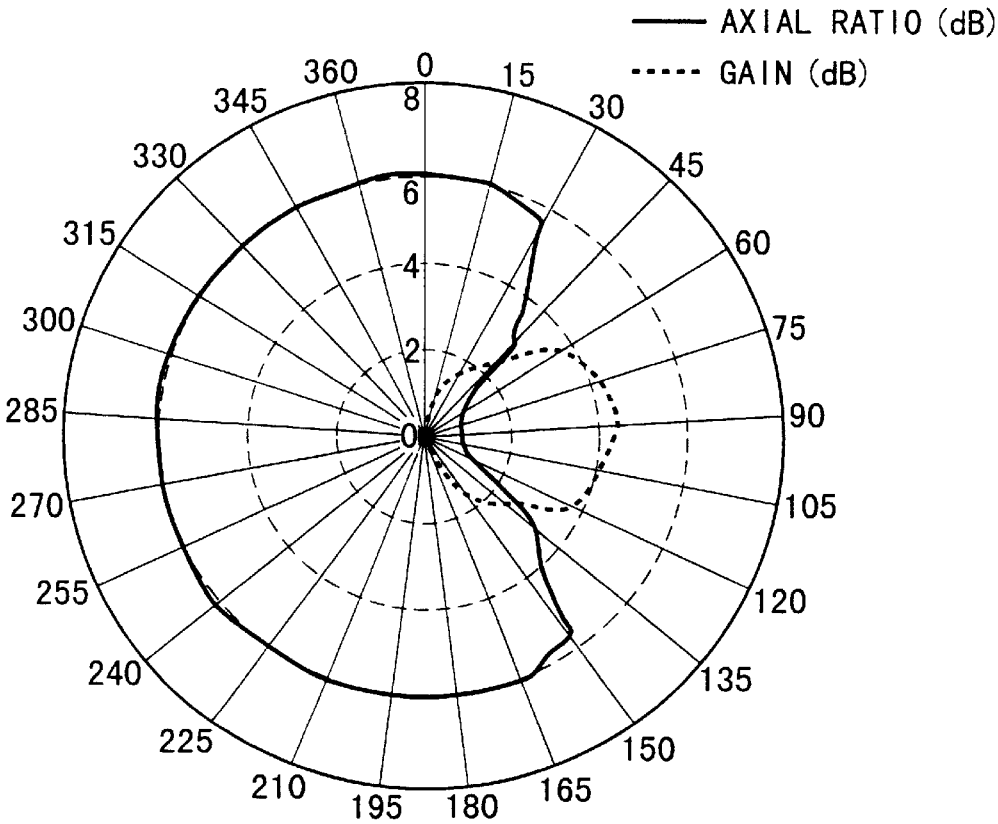
FIG. 7 is a graph showing the radiation pattern of the antenna according to the first embodiment of FIG. 4 by the direction dependence of the axial ratio and the gain, which was obtained by computer simulation.

The patch antenna according to the first embodiment of FIG. 4 has a radiation pattern shown in FIG. 7. As seen from FIG. 7, the antenna has a peak gain of 4.5 dBc in a specific direction and the axial ratio is minimized in the same direction.

As a result, it is seen from FIGS. 6 and 7 that both the axial ratio setting and the impedance matching can be optimized in the antenna according to the first embodiment.

Figure 8:
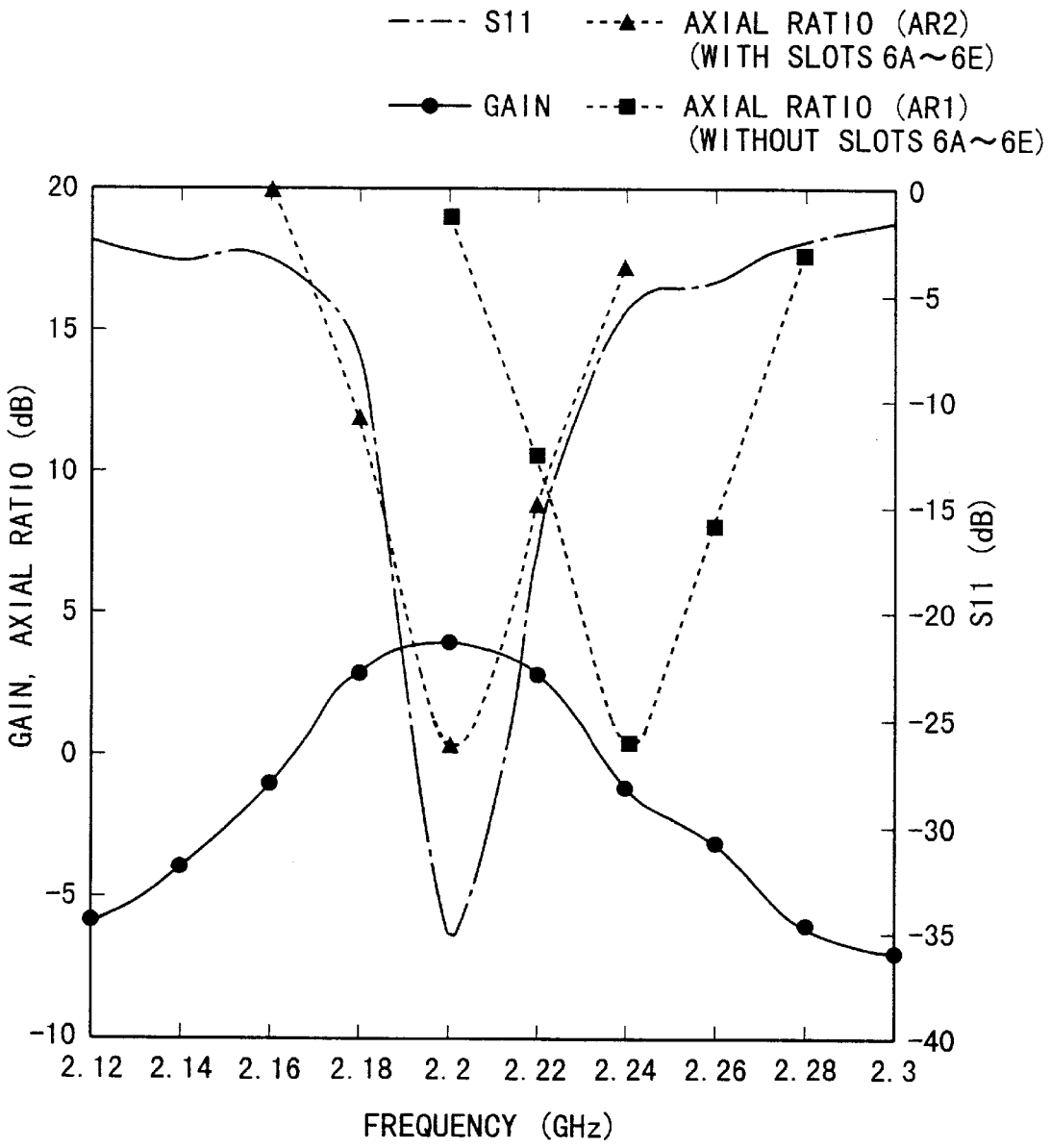
FIG. 8 is a graph showing the frequency dependence of the axial ratio, the gain, and the component S11 of the S parameter of the antenna according to the first embodiment of FIG. 4, which was obtained by experiments.

FIG. 8 shows the frequency dependence of the axial ratio, the gain, and the component S11 of the S parameter of the antenna according to the first embodiment of FIG. 4, which was obtained by experiments. In FIG. 8, the curve AR1 shows the frequency dependence of the axial ratio when the slots 6A, 6B, 6C, 6D, 6E, and 6F are removed in the antenna according to the first embodiment. The curve AR2 shows the frequency dependence of the axial ratio of the antenna according to the first embodiment having the slots 6A, 6B, 6C, 6D, 6E, and 6F.

As seen from the FIG. 8, the component S11 of the S parameter is minimized (i.e., impedance-matched) at the frequency of 2.2 GHz and the antenna gain is maximized at the same frequency. The maximum value of the gain is as high as approximately 4.5 dB. As seen from the curve AR2, the axial ratio is minimized at the frequency of 2.2 GHz when the slots 6A, 6B, 6C, 6D, 6E, and 6F are provided. When the slots 6A, 6B, 6C, 6D, 6E, and 6F are not provided, as seen from the curve AR1, the axial ratio is minimized at the frequency of 2.24 GHz, which is shifted from the desired frequency 2.2 GHz.

With the patch antenna according to the first embodiment shown in FIGS. 4 and 5, as explained above, the long side 1*a* of the rectangular patch 1 has the slots 6A, 6B, and 6C that inwardly extends from the side 1*a* and that is perpendicular to the side 1*a,* and at the same time, the shirt side 1*b* of the patch 1 has the slots 6D, 6E, and 6F that inwardly extends from the side 1*b* and that is approximately perpendicular to the side 1*b*. Therefore, the effect due to the rectangular aperture 7 of the patch 1 can be compensated by the slots 6A, 6B, 6C, 6D, 6E, and 6F.

As a result, the patch antenna according to the first embodiment has an improved degree of freedom to optimize both the axial ratio setting of polarization and the impedance matching between the antenna and its feed line. In other words, both the axial ratio setting and the impedance matching can be optimized easily.

In general, when a rectangular patch for circularly polarized waves is formed on the flat surface of a dielectric substrate, an obtainable antenna gain at a given frequency is determined by the resonant length of the patch. Therefore, to minimize the axial ratio while maximizing the level of impedance matching, the location of a feedpoint needs to be optimized. However, if an aperture is formed in the patch to expose the underlying surface of the substrate for the purpose of providing an additional antenna element such as an inner dipole, the location of a feedpoint is comparatively difficult to be optimized. This will be easily understood from the curve AR1 in FIG. 8.

Figure 3:
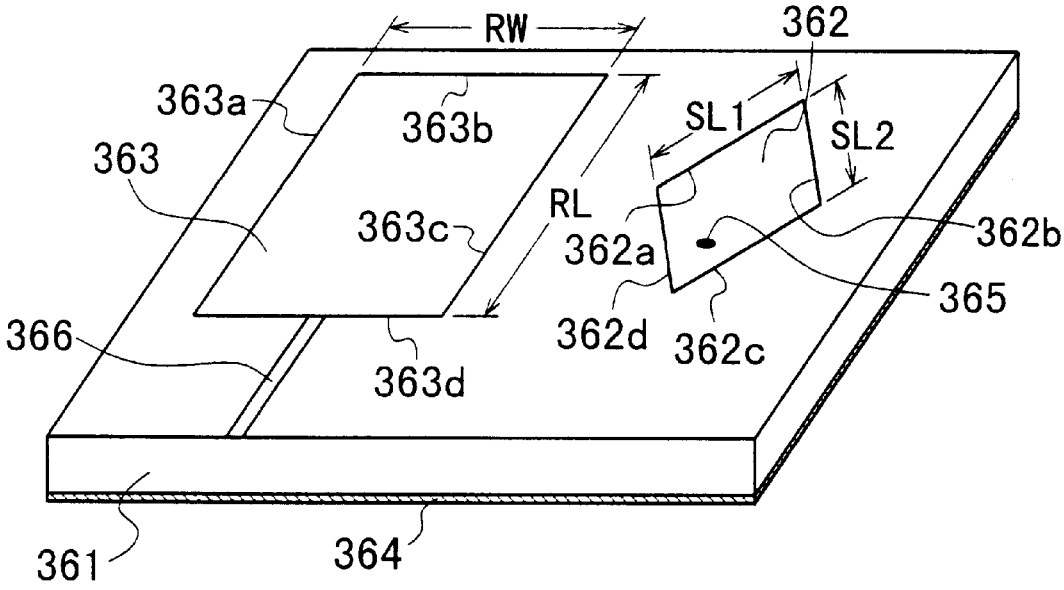
FIG. 3 PRIOR ART
FIG. 3 is a schematic perspective view showing a further prior-art circularly and linearly polarized antenna operable at two different frequency bands.

Unlike this, in the patch antenna according to the first embodiment in FIGS. 3 and 4, the location of a feedpoint is easily optimized because of the slots 6A, 6B, 6C, 6D, 6E, and 6F by using computer simulation. This will be easily understood from the curve AR2 in FIG. 8.

As described above, in the patch antenna according to the first embodiment, both the satisfactory impedance matching and the minimized axial ratio can be realized while using the single feedpoint 2.

Second Embodiment

Figure 9:
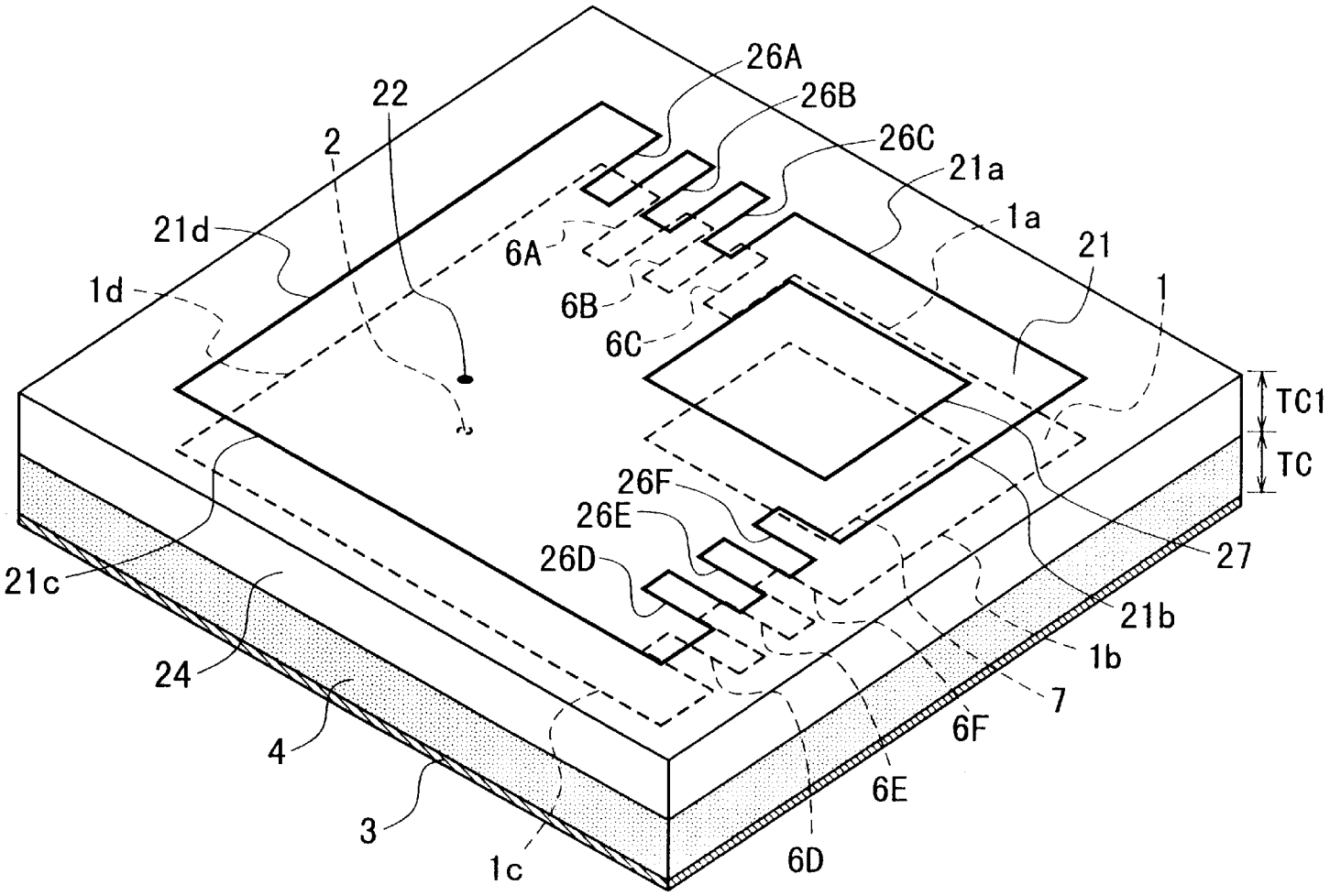
FIG. 9 is a schematic perspective view showing the configuration of a circularly polarized antenna operable at two different frequency bands according to a second embodiment of the present invention.
Figure 10:
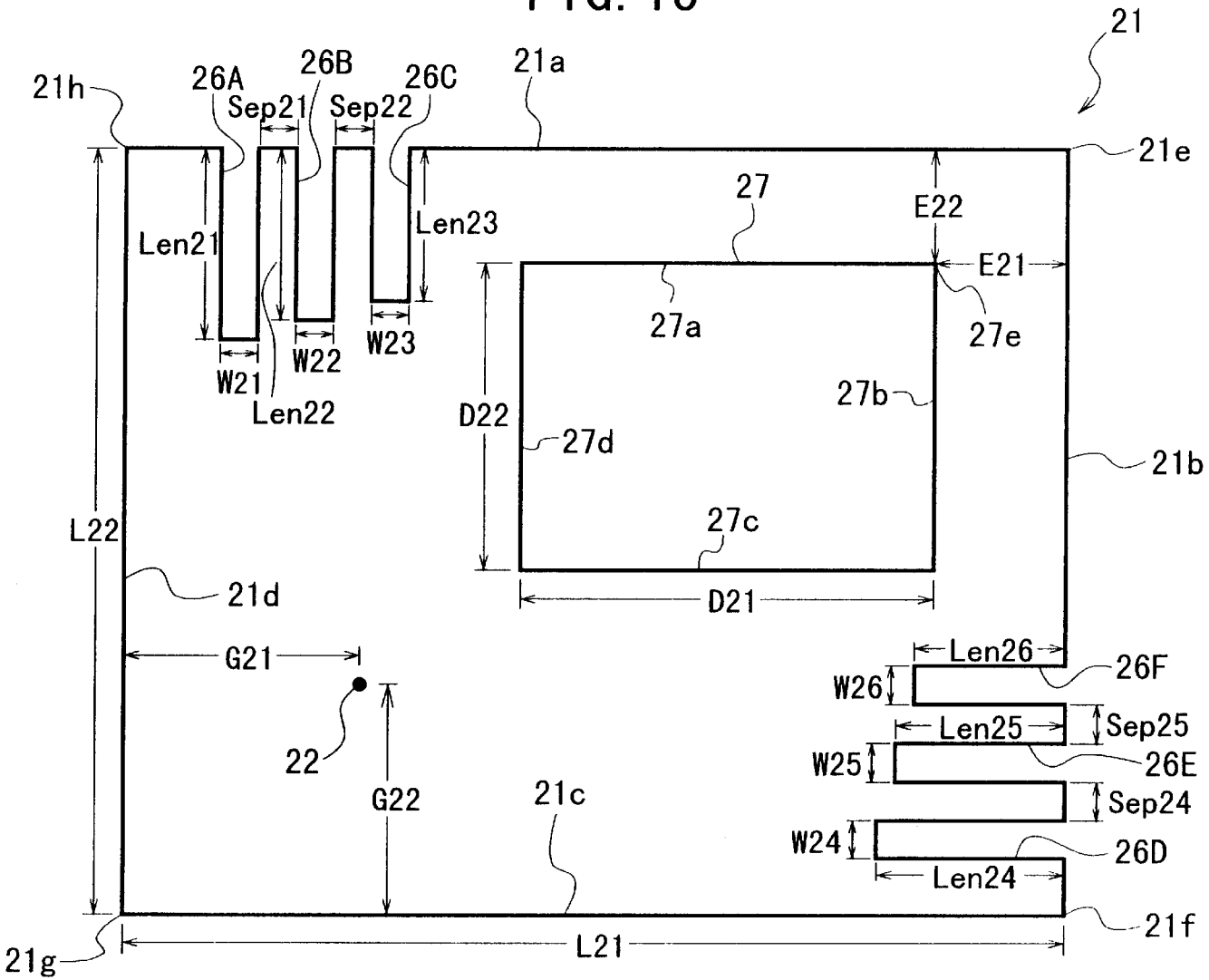
FIG. 10 is an enlarged plan view showing the configuration of the patch of the antenna according to the second embodiment or FIG. 9.

FIGS. 9 and 10 show a patch antenna according to a second embodiment of the present invention, which is operable at two different frequency bands, i.e., which serves as a double frequency antenna.

This antenna has a configuration obtained by adding a rectangular dielectric layer 24 and a rectangular conductor patch 2 to the antenna according to the first embodiment shown in FIGS. 4 and 5. Therefore, the explanation about the same configuration as that of the first embodiment is omitted here for simplification by attaching the same reference symbols as those in the first embodiment to the same elements in FIG. 9.

Specifically, the dielectric layer 24, which has a thickness of TC1 and a dielectric constant P2, is formed on the upper surface of the dielectric substrate 4 to be entirely overlapped with the substrate 4. The shape of the patch 21 is shown in detail in FIG. 10.

As shown in FIG. 10, the rectangular patch 21 has two long sides 21*a* and 21*c* with the same length of L21 and two shorts sides 21*b* and 21*d* with the same length of L22, where L21>L22. The patch 21 has a rectangular aperture 27 that exposes the upper surface of the dielectric layer 24 from the patch 21. The aperture 27 is formed to provide an additional antenna element such as a monopole or dipole onto the upper surface of the layer 24 while electrically separating the additional antenna element from the patch 21. The aperture 27 has two long sides 27*a* and 27*c* with the same length of D21 and two short sides 27*b* and 27*d* with the same length of D22, where D21>D22.

The corner 27*e* of the aperture 27 is the nearest to the corner 21*e* of the patch 21. The corner 27*e* is apart from the adjoining short side 21*b* of the patch 21 by a distance E21 and from the adjoining long side 21*a* of the patch 21 by a distance E22.

A feedpoint 22 for feeding electric power to the patch 21 is located at a point nearest to the corner 21*g* of the patch 21 opposite to the corner 21*e* thereof. The feedpoint 22 is apart from the adjoining short side 21*d* of the patch 21 by a distance G21 and from the adjoining long side 21*c* of the patch 21 by a distance G22. Electric power is supplied to the patch 21 from its backside at the feedpoint 22 by way of a feed line (not shown) which is electrically connected to the feedpoint 22 through the dielectric layer 24.

The feedpoint 22 for the upper patch 21 is located to be overlapped with the feedpoint 2 for the lower patch 1 in this embodiment, where electric power is supplied to the patches 1 and 21 through a common feed line. However, the feedpoint 22 may be located not to be overlapped with the feedpoint 2, where electric power is supplied to the patches 1 and 21 through respective feed lines.

The patch 21 includes three rectangular slots 26A, 26B, and 26C at its long side 21*a* and three rectangular slots 26D, 26E, and 26F at its short side 21*b*. The slots 26A, 26B, and 26C, which are located near the corner 21*h* of the patch 21, extend inwardly from the long side 21*a* to be perpendicular thereto. In other words, the slots 26A, 26B and 26C extend in parallel to the short sides 21*b* and 21*d*. The widths of the slots 26A, 26B, and 26C are defined as W21, W22, and W23, and the lengths thereof are as Len21, Len22, and Len23, respectively. The slots 26A and 26B are apart from each other as a distance of Sep21, and the slots 26B and 26C are at a distance of Sep22.

The slots 26D, 26E, and 26F, which are located near the corner 21*f* of the patch 21 opposite to its corner 21*h*, extend inwardly from the short side 21*b* to be perpendicular thereto. In other words, the slots 26D, 26E, and 26F extend in parallel to the long sides 21*a* and 21*c*. The widths of the slots 26D, 26E, and 26F are defined as W24, W25, and W26, and the length thereof are as Len24, Len25, and Len26, respectively. The slots 26D and 26E are apart from each other at a distance of Sep24, and the slots 26E and 26F are at a distance of Sep25.

By suitably setting the values of the widths W21, W22, W23, W24, W25, and W26, the lengths Len21, Len22, Len23, Len24, Len25, and Len26, and the distances Sep21, Sep22, Sep23, and Sep24 of the slots 26A, 26B, 26C, 26D, 26E, and 26F, both the axial ratio setting and the impedance matching can be optimized at a desired frequency f2 different from the above-described frequency f1.

It is needless to say that the values of the width W21, W22, W23, W24, W25, and W26 may be equal to or different from each other according to the necessity. This is applied to the values of the length Len21, Len22, Len23, Len24, Len25, and Len26, and those of the distance Sep21, Sep22, Sep23, and Sep24.

With the patch antenna according to the second embodiment shown in FIGS. 9 and 10, as explained above, because of the same reason as shown above with respect to the patch 1 in the first embodiment, the effect caused by the rectangular aperture 27 of the patch 21 can be compensated by adjusting the number, dimension, and/or layout of the sots 26A, 26B, 26C, 26D, 26E, and 26F. As a result, the patch antenna according to the second embodiment has an improved degree of freedom to optimize both the axial ratio setting and the impedance matching between the antenna and its feed line. In other words, both the axial ratio setting and the impedance matching can be optimized easily. Moreover, the optimization is simultaneously realized at the two different frequencies f1 and f2.

In the above-described first and second embodiments, three slots are formed at one long side of a rectangular patch and three slots are at one short side thereof, along with one rectangular aperture. However, the invention is not limited to this case. The number, shape (i.e., length, width, or the like), distance, and/or layout of these slots may be changed according to the necessity, i.e., the number, shape, and/or size of the aperture.

Third Embodiment

Figure 11:
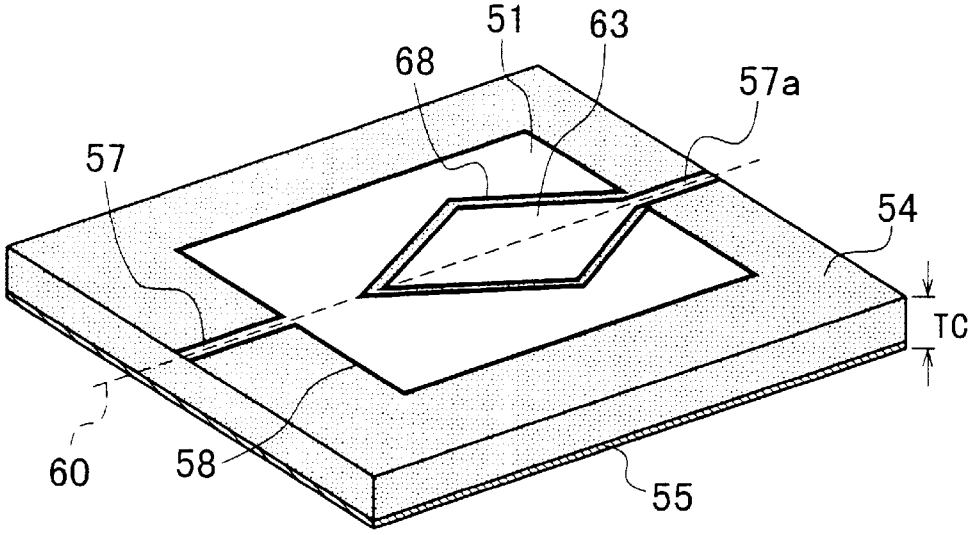
FIG. 11 is a schematic perspective view showing the configuration of a circularly and linearly polarized antenna operable at two different frequency bands according to a third embodiment of the present invention.
Figure 12:
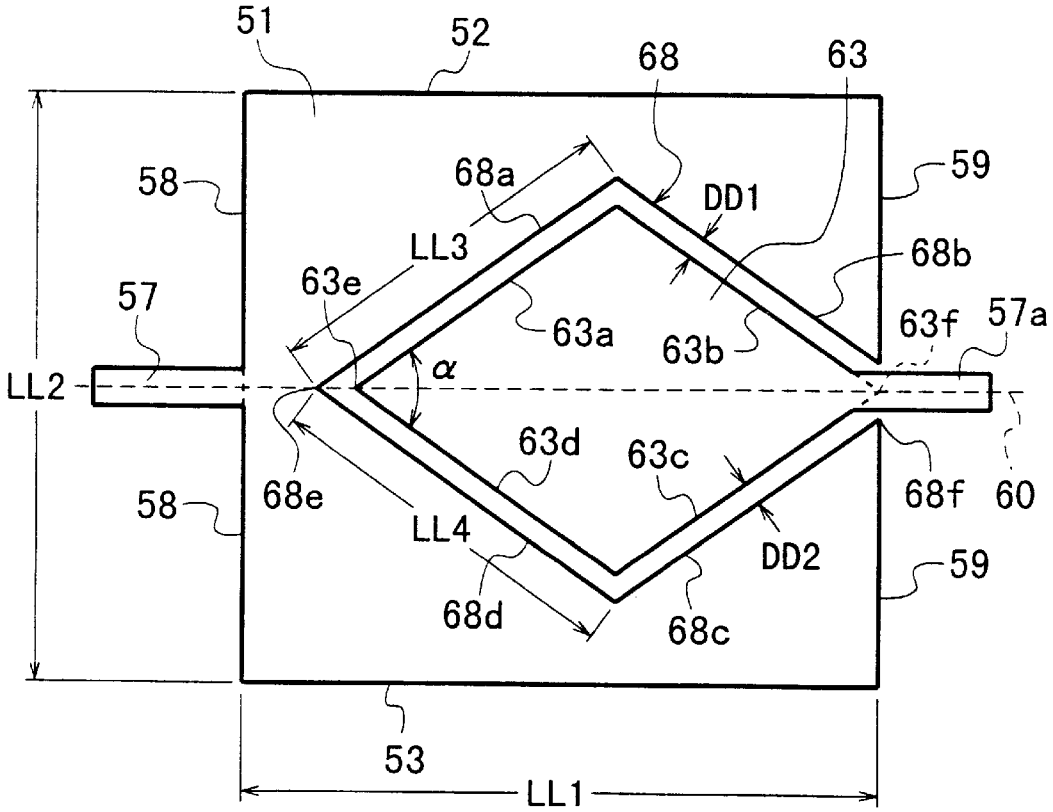
FIG. 12 is an enlarged plan view showing the configuration of the two patches of the antenna according to the third embodiment of FIG. 11.

FIGS. 11 and 12 show a dual-mode patch antenna according to a third embodiment of the present invention, which is operable as a circularly polarized antenna at a first frequency f1 and as a linearly polarized antenna at a second frequency f2 higher than f1. The antenna is connected to an unillustrated matching network for impedance matching between the antenna and a feed system.

As shown in FIG. 11, the patch antenna according to the third embodiment is comprised of a dielectric substrate 54 having a thickness of TC and a dielectric constant of P1, an approximately rectangular conductor patch 51 serving as a radiating element formed on the upper surface of the substrate 54, and a rectangular plate-shaped ground conductor 55 serving as a ground plane formed on the lower surface of the substrate 54 to be opposite to the patch 51.

As clearly shown in FIG. 12, the patch 51 has two long sides 52 and 53 with the same length of LL1 and two short sides 58 and 59 with the same length of LL2, where LL1>LL2. The opposite sides 52 and 53 serve as resonant sides and the opposite sides 58 and 59 as non-resonant sides. A microstrip line 57 is formed on the upper surface of the substrate 54 as a feed line for the patch 51. The end of the feed line 57 is connected to the patch 51 at substantially the center of the non-resonant side 58. The line 57 extends perpendicular to the sides 58 and 59 and in parallel to the sides 52 and 53.

The patch 51 has a parallelogrammic aperture 68 at approximately the center, which exposes the upper surface of the dielectric substrate 54 from the patch 51. The aperture 68 is formed to provide another patch 63 onto the upper surface of the substrate 54 while electrically separating the patch 63 from the patch 51. The aperture 60 has two edges 60*a* and 60*b* with the same length of LL3 and two edges 68*c* and 68*d* with the same length of LL4. The corner 68*e* of the aperture 68 has an acute angle $\alpha$. The opposite corner of the aperture 68 to the corner 68*e* is overlapped with the side 59 of the patch 51, thereby communicating the aperture 68 with the outside of the patch 51 through a hole 68*f* formed at the side 59.

A parallelogrammic conductor patch 63 serving as a radiating element is formed on the upper surface of the substrate 54 in the parallelogrammic aperture 68 of the patch 51. The patch 63, which is slightly smaller than the aperture 68, has a shape analogous to that of the aperture 68. The patch 63 has two sides 63*a* and 63*b* with the same length and two sides 63*c* and 63*d* with the same length. The sides 63*a* and 63*b* are opposite to the edges 68*a* and 68*b* of the aperture 68 and apart therefrom at a same gap DD1, respectively. The sides 63*c* and 63*d* are opposite to the edges 68*c* and 68*d* of the aperture 68 and apart therefrom at a same gap DD2, respectively.

The aperture 68 has a diagonal line 60 that passes through the opposing corners 63*e* and 63*f* of the patch 53. A feedline 57*a* is formed on the upper surface of the substrate 54 as a feed line for the patch 63. The feedline 57*a* also extends along the line 60, which is perpendicular to the short side 59 of the patch 51. The end of the feed line 57*a* is connected through the hole 68*f* of the aperture 68 to the patch 51 near its corner 63*f*.

The rectangular patch 51 serves as a linearly polarized antenna, since the feed line 57 is connected to the center of the non-resonant side 58. Also, the parallelogrammic patch 63 serves as a circularly polarized antenna, since the feed line 57*a* is connected to the corner 63*f*. Moreover, the length LL1 of the resonant sides 52 and 53 of the patch 51 is equal to a half wavelength and the patch 63 is located inside the patch 51. Therefore, the patch 63 serving as a circularly polarized antenna operates at a first frequency f1 an the patch 51 serving as a linearly polarized antenna operates at a second frequency f2 higher than f1. This means that the patch antenna according to the third embodiment is a dual-mode antenna with the circularly and linearly polarization modes.

By adjusting suitably the values of the gaps DD1 and DD2 between the patches 51 and 63, the gain of the antenna can be maximized while optimizing or maximizing the level of impedance matching at the two frequencies f1 and f2.

The shape of the aperture 68 of the patch 51 may be any other quadrilateral than a parallelogram, such as a rectangle, square, or rhombus. In response to this, the shape of the patch 63 may be a rectangular, square, or rhombus analogous thereto.

A numerical example of the patches 51 and 63 is shown below.

The dielectric substrate 54 is formed by a polyphenylene oxide (PPO) sheet with the thickness TC of 60 mil (=1.524 mm) and the dielectric constant P1 of 10. The rectangular patch 51 has the resonant side length LL1 of 70 mm and the non-resonant side length LL2 of 58.79 mm, which is formed by a well known printing process. The aperture 68 of the patch 51 is square, where the side lengths LL3 mm and LL4 are both 15.92 mm. According to the shape of the aperture 68, the patch 63 also is square and the top angle $\alpha$ if 90°. The gap distances DD1 and DD2 between the patches 51 and 68 are both 5.2 mm. In this case, the first frequency f1 for linearly polarized waves is set as 0.9 GHz and the second frequency f2 for circularly polarized waves is set as 2.12 GHz.

Using the patch antenna according to the third embodiment specified as above, the inventors actually performed computer simulation to obtain the frequency dependence of the gain and the component S11 of the S parameter and the radiation pattern. The results of the simulation is shown in FIGS. 13, 14, 15, and 16.

Figure 13:
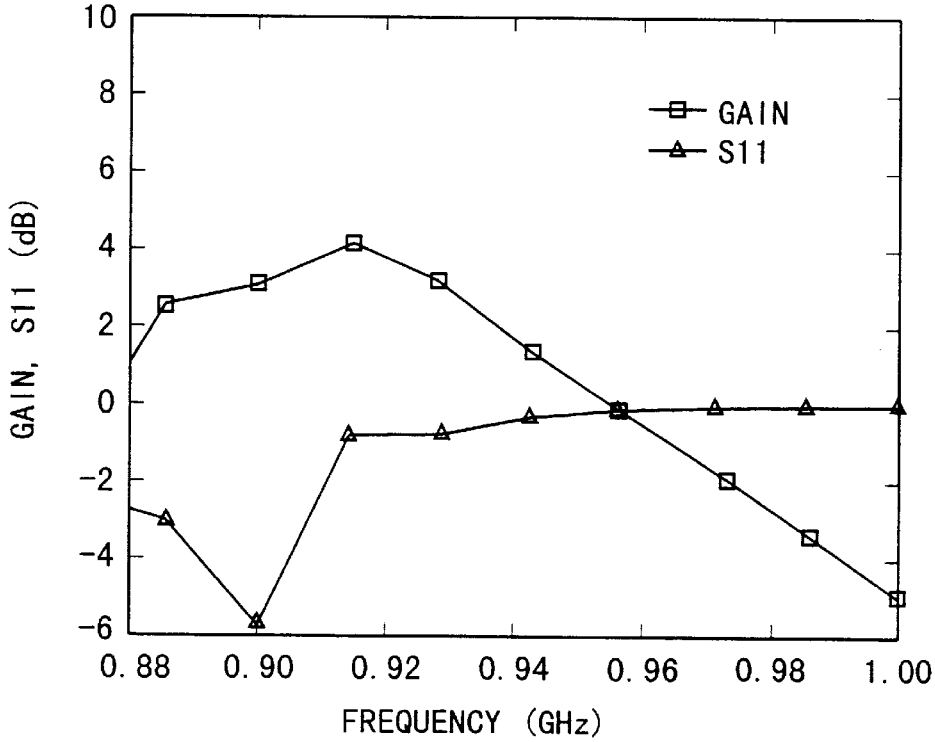
FIG. 13 is a graph showing the frequency dependence of the gain and the component S11 of the S parameter of the antenna according to the third embodiment of FIG. 11 near the frequency of 0.9 GHz, which was obtained by computer simulation.

As seen from FIG. 13, the component S11 of the S parameter is minimized at the frequency of 0.9 GHz, in other words, a resonance occurs at the frequency of 0.9 GHz. This means that the impedance matching between the patch antenna and its feed line is optimized. In response to the optimized impedance, the antenna gain is almost maximized at the same frequency of 0.9 GHz. The value of the gain at 0.9 GHz is approximately 3 dB.

Figure 14:
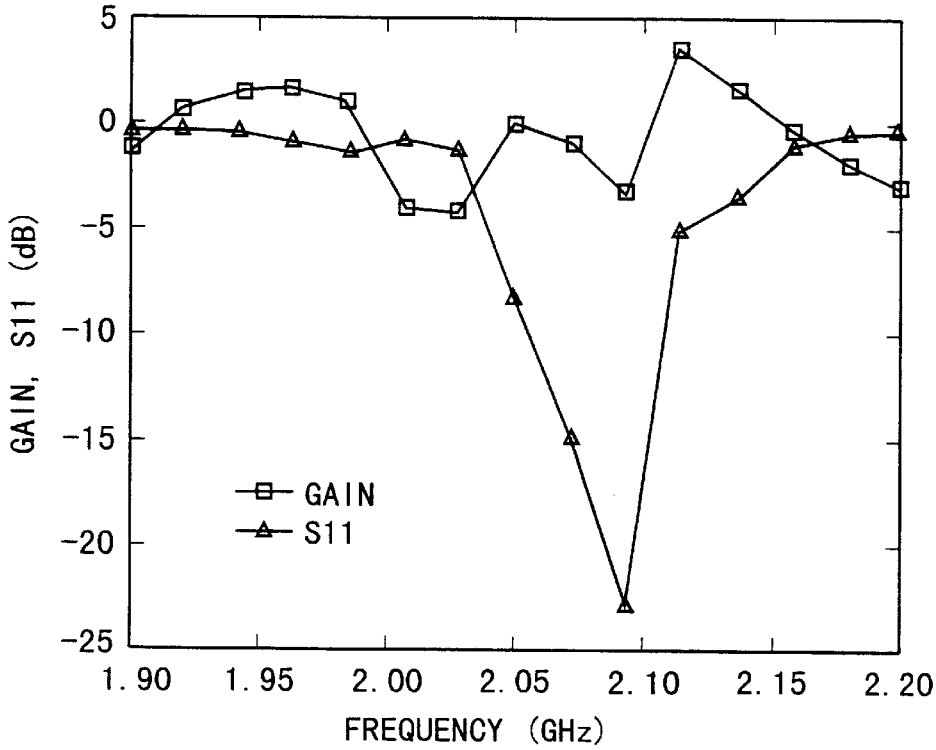
FIG. 14 is a graph showing the frequency dependence of the gain and the component S11 of the S parameter of the antenna according to the third embodiment of FIG. 11 near the frequency of 2.12 GHz, which was obtained by computer simulation.

As seen from FIG. 14, the component S11 of the S parameter is approximately minimized at the frequency of 2.12 GHz also, in other words, a resonance occurs at the frequency of 2.12 GHz also. This means that the impedance matching between the patch antenna and its feed line is approximately optimized at the frequency of 2.12 GHz. In response to the optimized impedance, the antenna gain is maximized the same frequency of 2.12 GHz. The value of the gain at 2.12 GHz is approximately 2 dB.

Figure 15:
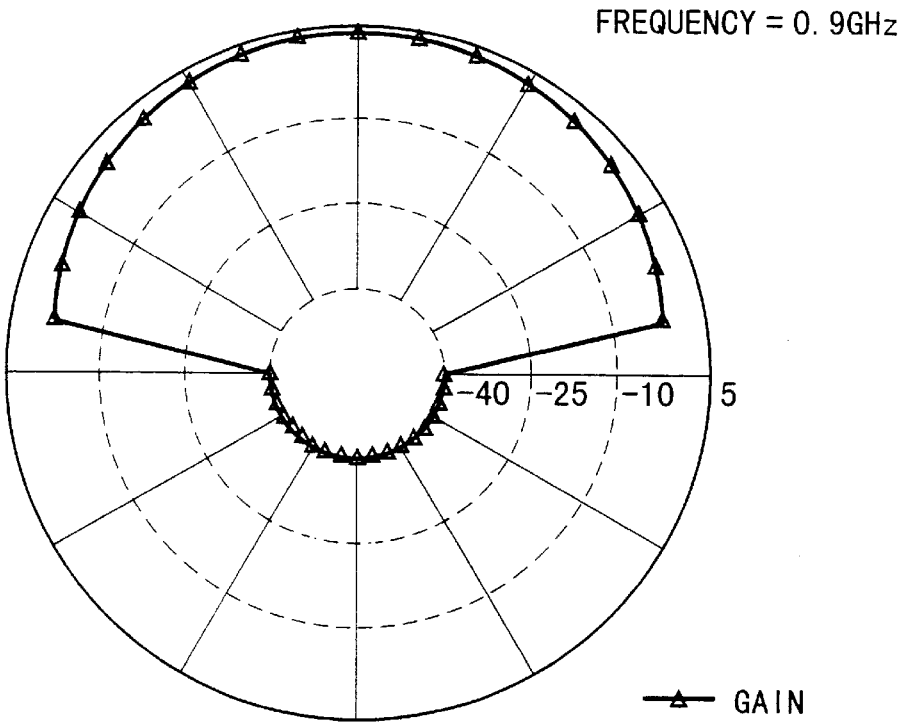
FIG. 15 is a graph showing the radiation pattern of the antenna according to the third embodiment of FIG. 11 by the direction dependence of the gain at the frequency of 0.9 GHz, which was obtained by computer simulation.
Figure 16:
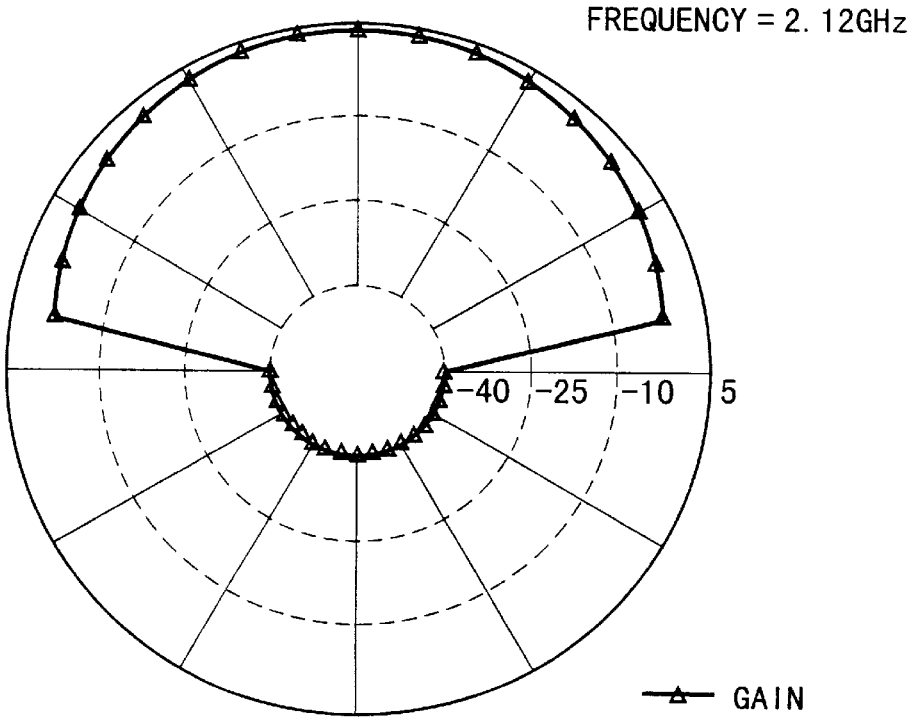

The patch antenna according to the third embodiment of FIGS. 11 and 12 has radiation patterns shown in FIGS. 15 and 16. As seen from FIGS. 15 and 16, the gain of the antenna is kept high within an extent of approximately 180° with respect to a specific direction at the frequencies of 0.9 GHz and 2.12 GHz.

The impedance matching and the gain level are optimized by using a matching network (not shown) provided outside the antenna. As a result, with the dual-mode patch antenna according to the third embodiment of FIGS. 11 and 12, desired antenna characteristics can be easily realized.

Fourth Embodiment

Figure 17:
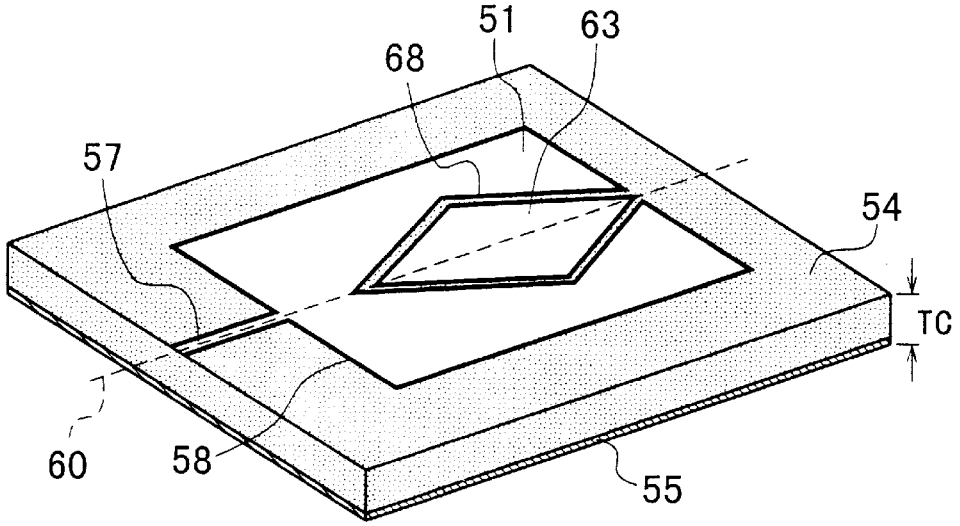
FIG. 17 is a schematic perspective view showing the configuration or a circularity and linearly polarized antenna operable at two different frequency bands according to a fourth embodiment of the present invention.
Figure 18:
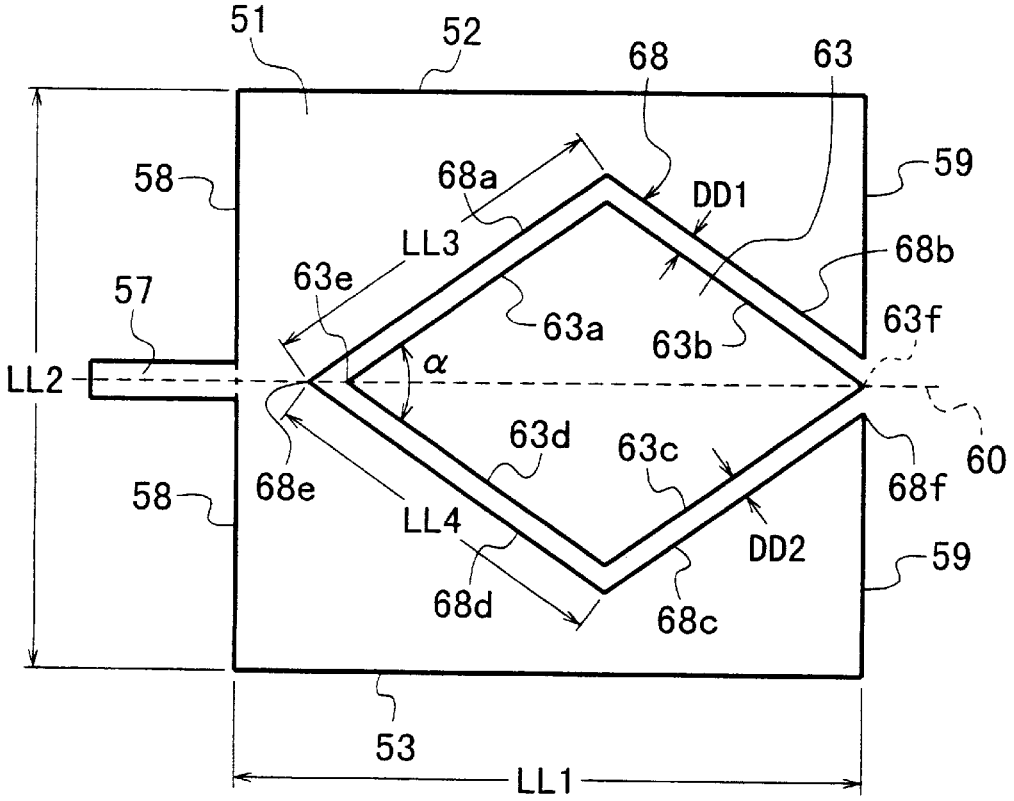
FIG. 18 is an enlarged plan view showing the configuration of the two patches of the antenna according to the fourth embodiment of FIG. 17.

FIGS. 17 and 18 show a dual-mode patch antenna according to a fourth embodiment of the present invention.

This antenna has a configuration obtained by removing the feed line 57*a* for the patch 63 from the antenna according to the third embodiment shown in FIGS. 11 and 12. Therefore, the explanation about the same configuration as that of the third embodiment is omitted here for simplification by attaching the same reference symbols as those in the third embodiment to the same elements in FIGS. 17 and 18.

The supply of electric power to the patch 63 is achieved by mutual coupling between the patches 63 and 51 through the gaps of DD1 and DD2. Therefore, electric power is supplied to the patch 63 by way of the patch 51.

A numerical example of the patches 51 and 63 is shown below.

The dielectric substrate 54 is formed by a polyphenylene oxide (PPO) sheet with a thickness TC of 60 mil (=1.524 mm) and a dielectric constant D1 of 10. The rectangular patch 51 has the resonant side length LL1 of 58.79 mm and the non-resonant side length LL2 of 70 mm, which is formed by a well-known printing process. The aperture 68 of the patch 51 is square, where the side lengths LL2 and LL4 are both 22.62 mm. The patch 63 also is square and the top angle $\alpha$ is 90°. The gap distances DD1 and DD2 are both as narrow as 0.7 mm and therefore, the patch 63 is electromagnetically coupled with the patch 51. As a result, electric power can be supplied to the patch 63 through the patch 51. In this case, the first frequency f1 for linearly polarized waves is set as 0.73 GHz and the second frequency f2 for circularly polarized waves is set as 2.125 GHz.

Using the patch antenna according to the fourth embodiment specified as above, the inventors actually performed computer simulation to obtain the frequency dependence of the gain and the component S11 of the S parameter and the radiation pattern. The results of the simulation is shown in FIGS. 19, 20, 21, and 2.

Figure 19:
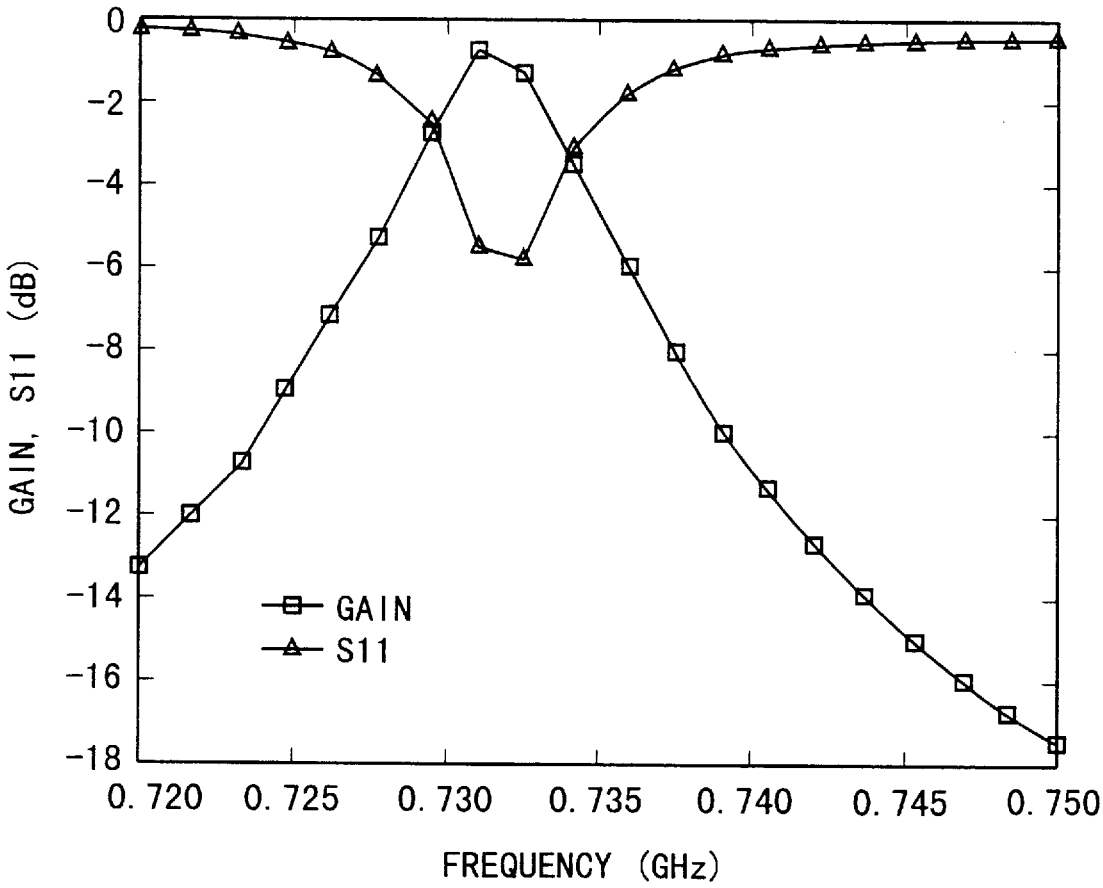
FIG. 19 is a graph showing the frequency dependence of the gain and the component S11 of the S parameter of the antenna according to the fourth embodiment or FIG. 17 near the frequency of 0.73 GHz, which was obtained by computer simulation.
Figure 20:
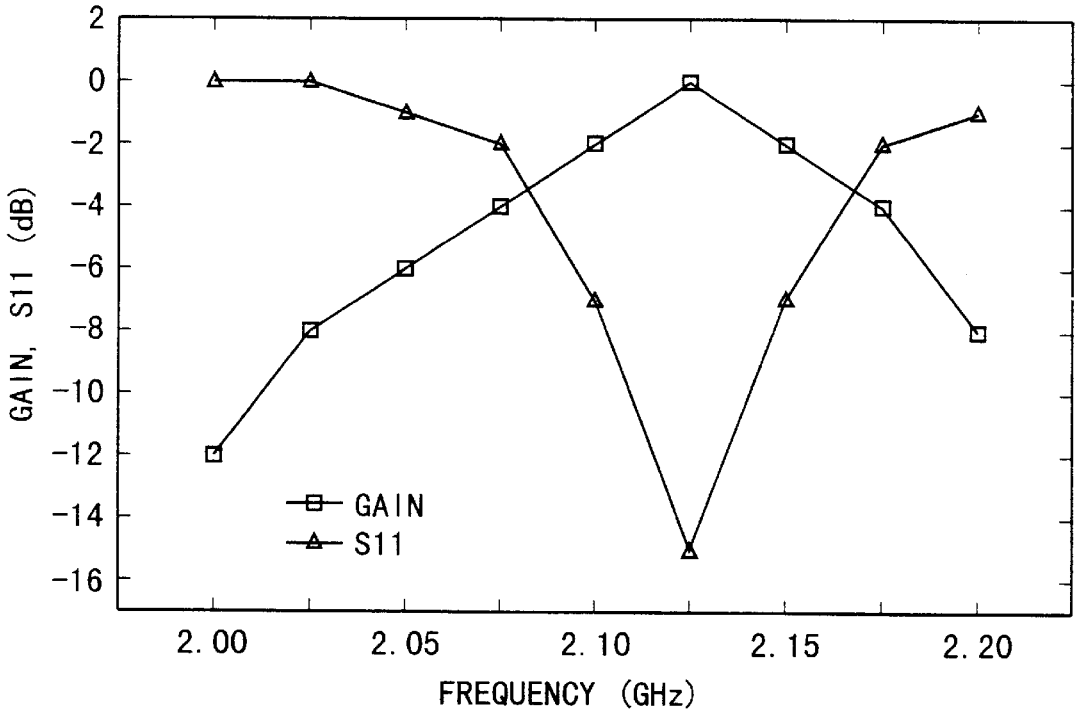
FIG. 20 is a graph showing the frequency dependence of the gain and the component 311 of the S parameter of the antenna according to the fourth embodiment of FIG. 17 near the frequency of 2.12 GHz, which was obtained by computer simulation.

As seen from FIGS. 19 and 20, the component S11 of the S parameter is minimized near the frequencies of 0.73 GHz and 2.125 GHz, in other words, a resonance occurs at the frequency of 0.73 GHz and 2.125 GHz. This means that the impedance matching between the patch antenna and its feed line is optimized. The antenna gain is almost maximized at the same frequencies of 0.73 GHz and 2.125 GHz. The value of the gain is approximately 0 dB at 0.73 GHz and approximately 2 dB at 2.125 GHz.

Figure 21:
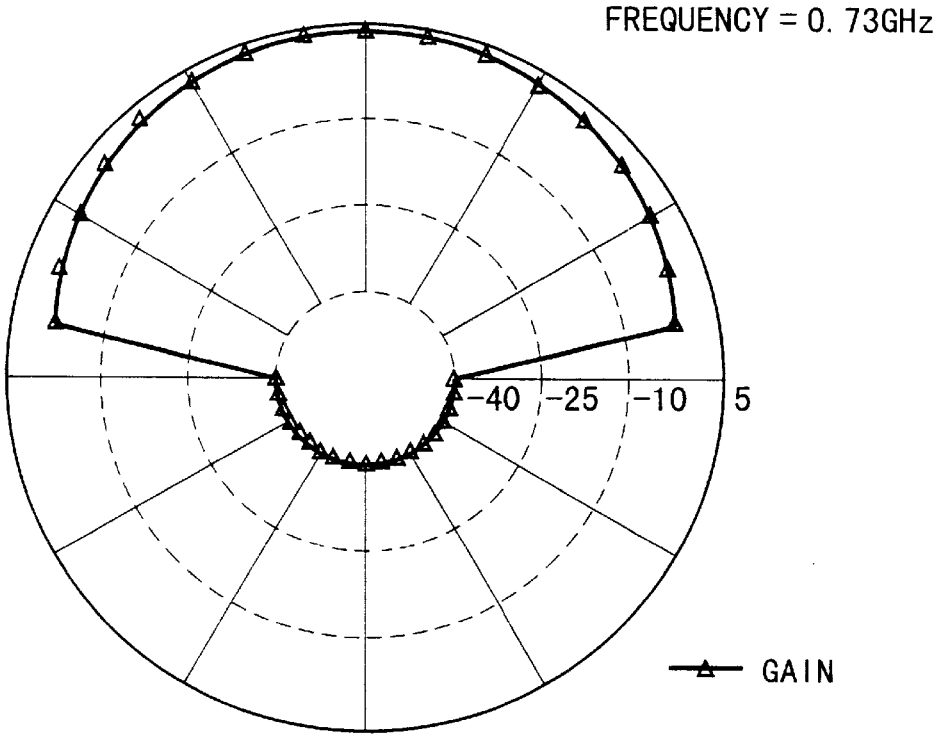
FIG. 21 is a graph showing the radiation pattern of the antenna according to the fourth embodiment of FIG. 17 by the direction dependence of the gain at the frequency of 0.73 GHz, which was obtained by computer simulation.
Figure 22:
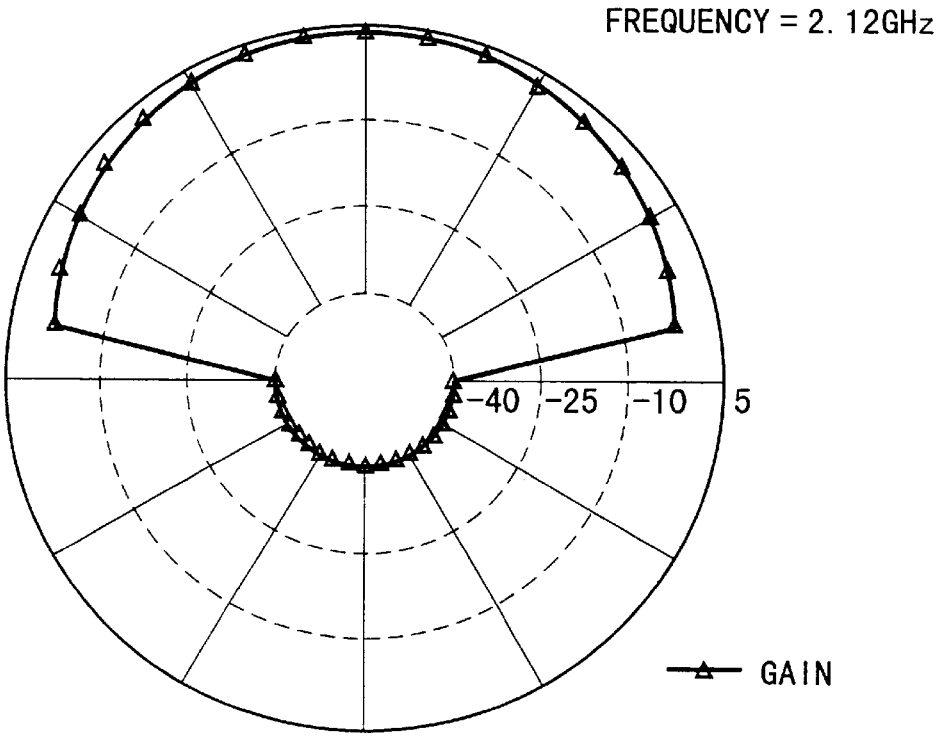
FIG. 22 is a graph showing the radiation pattern of the antenna according to the fourth embodiment of FIG. 17 by the direction dependence of the gain at the frequency of 2.12 GHz, which was obtained by computer simulation.

The patch antenna according to the fourth embodiment of FIGS. 17 and 18 has radiation patterns shown in FIG. 21 and 22. As seen from FIGS. 21 and 22, the gain of the antenna is kept high within an extent of approximately 180° with respect to a specific direction at 0.73 GHz and 2.125 GHz.

The impedance matching and the gain level are optimized by using a matching network (not shown) provided outside the antenna. As a result, with the dual-mode patch antenna according to the fourth embodiment, desired antenna characteristics can be easily realized.

Fifth Embodiment

Figure 23:
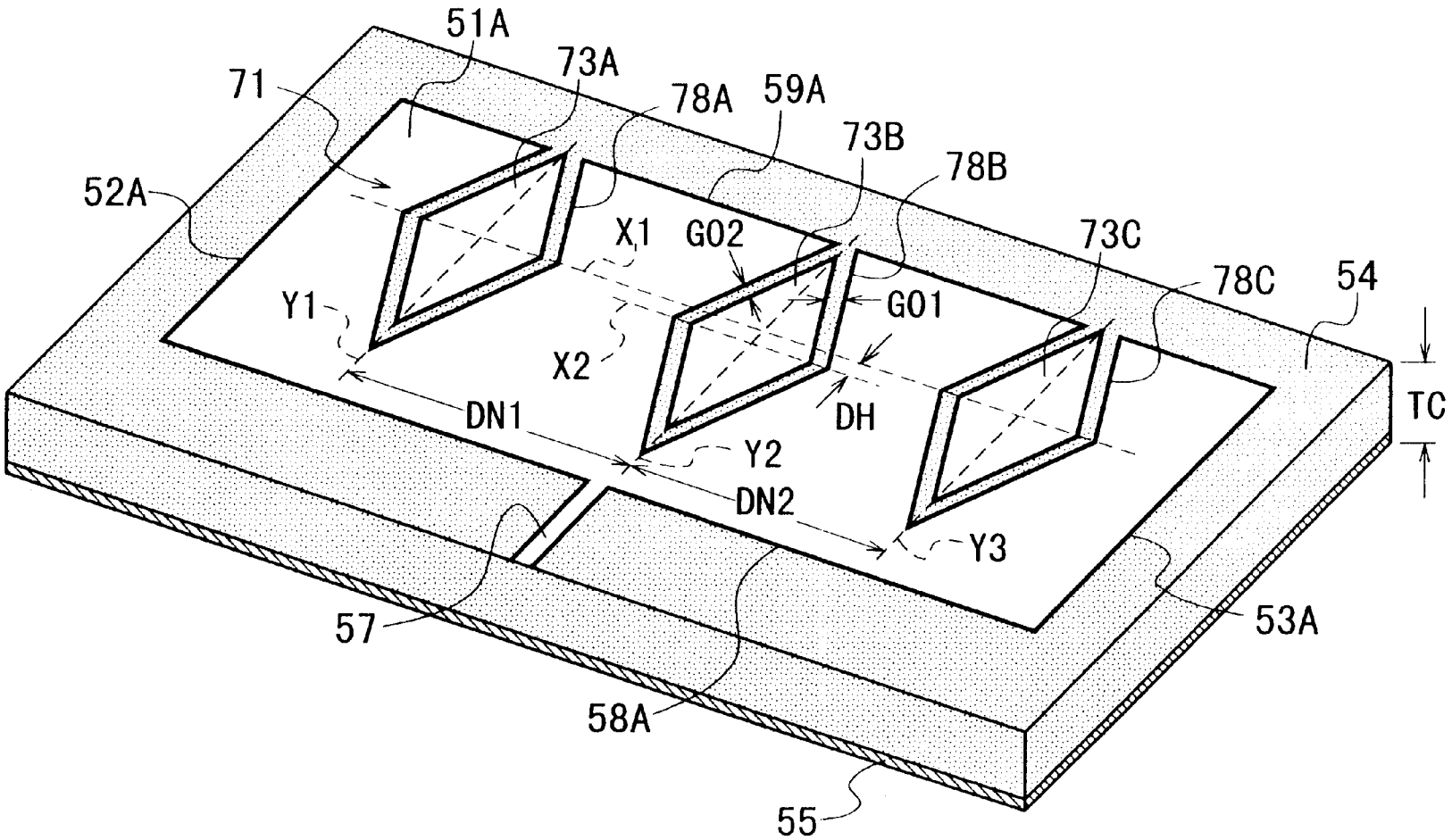
FIG. 23 is a schematic perspective view showing the configuration of a circularly and linearly polarized antenna operable at two different frequency bands according to a fifth embodiment of the present invention.

FIG. 23 shows a dual-mode patch antenna according to a fifth embodiment of the present invention, in which three parallelogrammic patches 73A, 73B, and 73C are formed in three parallelogrammic apertures 78A, 78B, and 78C of a rectangular patch 51A, respectively. Each of the inner patches 73A, 73B and 73C is apart from specific gaps G01 and G02 from corresponding inner edges of the apertures 78A, 78B, and 78C, which is similar to the antenna according to the fourth embodiment of FIGS. 17 and 18.

The diagonal lines of the inner patches 73A and 73C, which are in parallel to the non-resonant sides 58A and 59A of the outer patch 51A, are located on a straight line X1. The diagonal line of the patch 73B, which is in parallel to the sides 58A and 59A of the patch 51A, is located on a straight line X2 apart from the line X1 by a distance DH, where the line X2 is in parallel to the line X1. Diagonal lines Y1, Y2, and Y3 of the patches 73A, 73B, and 73C, which are in parallel to the resonant sides 52A and 53A of the patch 51A, are arranged at intervals DN1 and DN2, respectively.

By adjusting the values of the distance DH and the intervals DN1 and DN2, a desired radiation pattern can be realized. Also, by adjusting suitably the gaps G01 and G02 between the inner patches 73A, 73B, and 73C and the opposing edges of the apertures 78A, 78B, and 78C, both the gain and the impedance patching can be optimized as required.

The diagonal lines of the patches 73A and 73C which are in parallel to the sides 58A and 59A may be located on different straight lines. The intervals DN1 and DN2 may be equal to or different from each other. Although the outer patch 51A has three apertures where three inner patches are respectively located in the fifth embodiment of FIG. 23, it is needless to say that the number of apertures of the patch 51A and inner patches provided in these apertures may be two, four, or more according to the necessity.

With the dual-mode patch antenna according to the fifth embodiment of FIG. 23, both the impedance matching and the gain level are optimized by using a matching network (not shown) provided outside the antenna. As a result, desired antenna characteristics can be easily realized.

As seen from the fifth embodiment of FIG. 23, in the present invention, patches for circularly polarized waves may be arranged along a straight line so as to form a column (i.e., one-dimensionally) on a same patch for linearly polarized waves.

Sixth Embodiment

Figure 24:
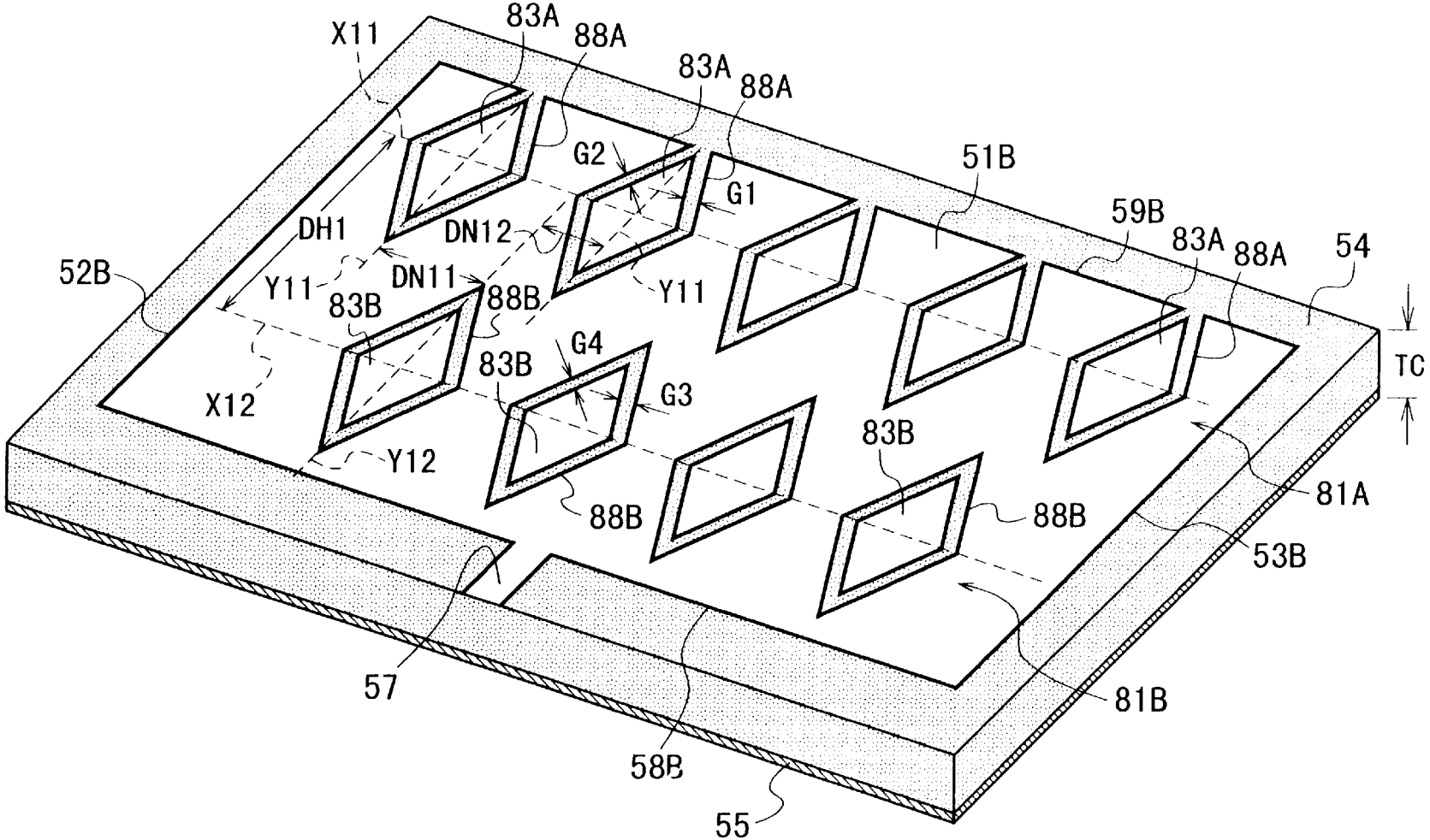
FIG. 24 is a schematic perspective vie showing the configuration of a circularly and linearly polarized antenna operable at two different frequency bands according to a sixth embodiment of the present invention.

FIG. 24 shows a dual-mode patch antenna according to a sixth embodiment of the present invention, in which five parallelogrammic patches 83A are formed in five parallelogrammic apertures 88A of a rectangular patch 51B and four parallelogrammic patches 83B are formed in four parallelogrammic apertures 88B of the same patch 51B, respectively. The five parallelogrammic patches 83A, which are arranged at equal intervals, constitute a first patch array 81A. The four parallelogrammic patches 83B, which are arranged at equal intervals, constitute a second patch array 81B.

Each of the inner patches 83A in the first patch array 81A is apart from specific gaps G1 and G2 from corresponding inner edges of the apertures 88A, which is similar to the antenna according to the fourth embodiment of FIGS. 17 and 18. Each of the inner patches 83B in the second patch array 81B is apart from specific gaps G3 and G4 from corresponding inner edges of the apertures 88B, which is also similar to the antenna according to the fourth embodiments of FIGS. 17 and 18.

Diagonal lines of the patches 83A in the first patch array 81A, which are in parallel to the non-resonant sides 58B and 59B of the outer patch 51B, are located on a straight line X11. Diagonal lines of the patches 83B in the second patch array 81B, which are in parallel to the sides 58B and 59B, are located on another straight line X12 apart from the line X11 by a distance DH1. Diagonal lines Y11 of the patches 83A extending in parallel to the resonant sides 52B and 53B of the patch 51B are parallel to diagonal lines Y12 of the patches 83B extending in parallel to the same resonant sides 52B and 53B. Each of the patches 83B in the first patch array 81A is apart from the adjoining two patches 83A in the second patch array 81B at distances DN11 and DN12, respectively.

By adjusting suitably the values of the distance DH1 and DN11 and DN12, a desired radiation pattern can be realized. Also, by adjusting suitably the gaps G1, G2, G3, and G4 between the patches 83A and 83B and the opposing edges of the apertures 88A and 88B, the gain and the impedance patching can be optimized.

With the antenna according to the sixth embodiment of FIG. 24, both the impedance matching and the gain level are optimized by using a matching network (not shown) provided outside the antenna. As a result, desired antenna characteristics can be easily realized.

As seen from the sixth embodiment, patches for circularly polarized waves may be arranged to form an array (i.e., two-dimensionally) on a same patch for linearly polarized waves.

Needless to say, the distances DH1, DN11 and Dn12 may be equal to or different from each other with respect to the patches 88A and 88B, and the gaps G1, G2, G3, and G4 of the patches 88A and 88B may be equal to or different from each other. The patches 88A may be arranged at different intervals along the line X11, and the patches 88B may be arranged at different intervals along the line X12. Thus, the number, size, and layout of inner patches may be optionally determined according to the necessity.

While the preferred forms of the present invention have been described, it is to be understood that modifications will be apparent to those skilled in the art without departing from the spirit of the invention. The scope of the invention, therefore, is to be determined solely by the following claims.

What is claimed is:

1. A circularly polarized patch antenna comprising:

(a) a dielectric substrate having a first surface located on one side and a second surface located on the other side;

(b) an approximately rectangular patch serving as a radiating element formed on said first surface of said substrate;

said patch having an aperture from which said first surface of said substrate is exposed, a first side, and a second side adjoining to said first side;

said first side having a first slot that inwardly extends approximately perpendicular to said first side;

said second side having a second slot that inwardly extends approximately perpendicular to said second side;

(c) a ground conductor serving as a ground plane formed on said second surface of said substrate to be opposite to said patch; and (d) a feedpoint located on said patch for feeding or deriving electric power to or from said patch.

2. The antenna as claimed in claim 1, wherein said first side of said patch further has at least one additional slot and said second side of said patch further has at least one additional slot.

3. A circularly polarized patch antenna comprising:

(a) a dielectric substrate having a first surface located on one side and a second surface located on the other side;

(b) an approximately rectangular first patch serving as a first radiating element formed on said first surface of said substrate;

said first patch having an aperture from which said first surface of said substrate is exposed, a first side, and a second side adjoining to said first side;

said first side having a first slot that inwardly extends approximately perpendicular to said first side;

said second side having a second slot that inwardly extends approximately perpendicular to said second side;

(c) a dielectric layer formed on said first surface of said substrate to cover entirely said first patch;

(d) an approximately rectangular second patch serving as a second radiating element formed on a surface of said dielectric layer;

said second patch having a second aperture from which said surface of said dielectric layer is exposed, a third side, and a fourth side adjoining to said third side;

said third side having a third slot that inwardly extends approximately perpendicular to said third side;

said fourth side having a fourth slot that inwardly extends approximately perpendicular to said fourth side;

(e) a ground conductor serving as a ground plane formed on said second surface of said substrate to be opposite to said first patch;

(f) a first feedpoint located on said first patch for feeding or deriving electric power to or from said first patch; and (g) a second feedpoint located on said second patch for feeding or deriving electric power to or from said second patch.

4. The antenna as claimed in claim 3, wherein said first side of said first patch further has at least one additional slot, said second side of said first patch further has at least one additional slot, said third side of said second patch further has at least one additional slot, and said fourth side of said second patch further has at least one additional slot.

5. A dual-model patch antenna comprising:

(a) a dielectric substrate having a first surface located on one side and a second surface located on the other side;

(b) a first patch serving as a first radiating element formed on said first surface of said substrate;

said first patch having an opening from which said first surface of said substrate is exposed;

(c) a second patch serving as a second radiating element formed on said first surface of said substrate;

said second patch being located in said opening of said first patch and apart from said first patch at a specific gap;

(d) a ground conductor serving as a ground plane formed on said second surface of said substrate to be opposite to said first and second patches; and (e) a first feed line located on said first surface of said substrate for feeding or deriving electric power to or from said first patch.

6. The antenna as claimed in claim 5, wherein said first patch is approximately rectangular and said second patch is approximately quadrilateral;

and wherein said aperture of said first patch has a shape corresponding to a contour of said second patch, and said first feed line is connected to said first patch.

7. The antenna as claimed in claim 5, further comprising a second feed line formed on said first surface of said substrate for feeding or deriving electric power to or from said second patch;

wherein said aperture of said first patch is formed to communicate with its outside through a hole of said first patch, and said second feed line is connected to said second patch through said hole.

8. The antenna as claimed in claim 5, wherein feeding or deriving electric power to or from said second patch is performed by using said first feed line by way of said first patch.

9. A dual mode patch antenna comprising:

(a) a dielectric substrate having a first surface located on one side and a second surface located on the other side;

(b) a first patch serving as a first radiating element formed on said first surface of said substrate;

said first patch having first to (n−1)-th apertures from which said first surface of said substrate is exposed, where n is an integer greater than two;

(c) second to n-th patches serving as a second radiating element formed on said first surface of said substrate;

said second to n-th patches being respectively located in said first to (n−1)-th apertures of said first patch and apart from said first patch at specific gaps, respectively;

(d) a ground conductor serving as a ground plane formed on said second surface of said substrate to be opposite to said first to n-th patches; and (e) a first feed line located on said first surface of said substrate for feeding or deriving electric power to or from said first patch.

10. The antenna as claimed in claim 9, wherein said second to n-th patches are arranged along a non-resonant side of said first patch;

and wherein electric power is supplied to or derived from said second to n-th patches using electro-magnetic coupling between said first patch and said second to n-th patches.

11. The antenna as claimed in claim 9, wherein said second to n-th patches are entirely located in said first to (n−1)th apertures of said first patch, respectively.

12. The antenna as claimed in claim 9, wherein said first patch is approximately rectangular and said second to n-th patches are approximately quadrilateral.

* * * * *